US006954585B2

(12) United States Patent
Mokuo

(10) Patent No.: US 6,954,585 B2
(45) Date of Patent: Oct. 11, 2005

(54) SUBSTRATE PROCESSING METHOD AND APPARATUS

(75) Inventor: Shori Mokuo, Tosu (JP)

(73) Assignee: Tokyo Electron Limited, Tokyo-To (JP)

( * ) Notice: Subject to any disclaimer, the term of this patent is extended or adjusted under 35 U.S.C. 154(b) by 0 days.

(21) Appl. No.: 10/725,372

(22) Filed: Dec. 3, 2003

(65) Prior Publication Data

US 2004/0110106 A1 Jun. 10, 2004

(30) Foreign Application Priority Data

Dec. 3, 2002 (JP) ..... 2002-350724

(51) Int. Cl.[7] ..... F26B 19/00

(52) U.S. Cl. ..... 392/416; 392/418; 219/390; 219/405; 219/411; 118/724; 118/725; 118/50.1; 118/729; 118/730

(58) Field of Search ..... 219/390, 405, 219/411; 392/416, 418; 118/724, 725, 50.1, 729, 730

(56) References Cited

U.S. PATENT DOCUMENTS 6,140,256 A * 10/2000 Ushikawa ..... 438/795

FOREIGN PATENT DOCUMENTS

JP 7-249603 9/1995

* cited by examiner

*Primary Examiner*—Shawntina Fuqua
(74) *Attorney, Agent, or Firm*—Smith, Gambrell & Russell, LLP

(57) ABSTRACT

A method for heating a wafer to a predetermined temperature, the wafer being held by a holding unit and being accommodated in a processing container equipped with a heater. The wafer is heated to a processing temperature while positioning the wafer at an adjacent position that results form making the wafer approach the heating surface of the heater. After heating the wafer to the predetermined temperature, the wafer is separated from the flat bottom surface of the container body to a processing position. In this state, a processing chamber of the processing container is supplied with a processing fluid, while the holding unit and the heater are relatively moved close to and apart from each other intermittently or continuously. Accordingly, it is possible to quickly heat the substrate to a processing temperature while supplying the substrate with the processing fluid uniformly. This improves throughout and the homogenization in processing.

11 Claims, 12 Drawing Sheets

SUBSTRATE PROCESSING METHOD AND APPARATUS

BACKGROUND OF THE INVENTION

1. Technical Field of the Invention

This invention relates to substrate processing method and apparatus for processing a substrate, for example, semiconductor wafer, glass substrate for LCD, etc. with a processing fluid (e.g. ozone gas, vapor) while accommodating the substrate in a processing container.

2. Description of the Related Art

In the manufacturing process of semiconductor devices, generally, it is carried out to form a resist film on a substrate to be processed, for example, semiconductor water, LCD substrate, etc. by applying a resist liquid on the substrate. In connection, a designated circuit pattern is scaled down by technique of photo lithography and further transferred on the resist film for development. After the development, the resist film is removed from the substrate. Noted that the substrate, such as semiconductor water and LCD substrate, will be referred "wafer", hereinafter.

As the method for removing the resist film, there is proposed a method for using ozone ($O_3$) exhibiting easy discard process in view is environmental protection in recent years.

In the conventional manufacturing process for semiconductor devices using ozone, it is necessary to heat a wafer or the like accommodated in a processing chamber up to a predetermined temperature, for example, about 100° C. In order to prevent transfer of foreign material from heater to a wafer etc., conventionally, the heating is performed on condition that the wafer etc. is positioned above a support table consisting of a heater and a support mechanism by leaving a gap (e.g. clearance of 0.1 to 0.5 mm) from the support table. Then, the wafer is further processed with a processing fluid, such as ozone, while maintaining the above arrangement (see Japanese Unexamined Patent Publication No. 7-249603, Paragraph No.0007 and FIG. 1, for example).

Recently, another method for removing a resist film from a wafer is also proposed. In this method, after accommodating a wafer etc. in an ozone treatment chamber, the interior of the chamber is heated and pressurized. In this state, the wafer is supplied with processing gas (processing fluid) containing vapor and ozone to make soluble resist film. Subsequently, the wafer is transferred to a water washing chamber where the resist film is removed from the wafer.

In the conventional processing method, however, since the wafer is heated and processed with the processing fluid, for example, ozone while being mounted (or fixed) on the support table of the processing chamber through the designated gap of e.g. 0.1 to 0.5 mm, it is feared that the reduced gap between the wafer etc. and the support table causes the inflow of the processing gas to the gap to be stagnant to deteriorate the throughput of the apparatus and uniform processing. Additionally, if employing ozone and vapor as the processing fluid together with a heating mechanism exhibiting deteriorated uniformity, there is the possibility that steam is condensed on both parts of a substrate and the support table to make a hindrance in processing the substrate. While, if the gap between the wafer etc. and the support table is changed more than 0.5 mm, much time would be required to heat up the wafer etc.

SUMMARY OF THE INVENTION

Under such a circumference as mentioned above, an object of the present invention is to provide substrate processing method and apparatus by which it becomes possible to heat a substrate to be processed to a predetermined temperature in a short period and also possible to supply the substrate with a processing fluid uniformly to accomplish the improvement in throughput and the homogenization in processing.

In order to attain the above object to be solved, according to an invention, a substrate processing method for heating a substrate to be processed to a predetermined temperature, the substrate being held by holder and also accommodated in a processing container equipped with heater, and further processing the substrate to be processed while supplying a processing fluid into the processing container, the method comprises the steps of: moving the substrate to be processed close to a heating surface of the heater relatively thereby to heat the substrate to be processed to a processing temperature; moving the substrate to be processed apart from the heating surface of the heater to a processing position after heating the substrate to the processing temperature; and supplying the processing fluid into the processing container.

According to an invention, the substrate processing method further comprises the steps of: making the holder receive the substrate transferred from the exterior of the processing container at a delivery position before bring the substrate and the heating surface of the heater into relative closer relationship; and discharging the processing fluid for processing from the interior of the processing container after supplying the processing fluid into the processing container.

According to an invention, in the step of supplying the processing fluid into the processing container, the holder and the heating surface of the heater are relatively moved close to and apart from each other intermittently or continuously.

According to an invention, the substrate processing method further comprises the steps of: opening a lid body forming the processing container before making the holder receive the substrate at the delivery position; closing the lid body after bring the substrate and the heating surface of the heater into relative closer relationship and before a temperature of the substrate reaches to the processing temperature; and after discharging the processing fluid for processing from the interior of the processing container, again opening the lid body, transferring the substrate from the processing position to the delivery position and unloading the substrate out of the processing container.

According to an invention, the holder is capable of moving in and out of a processing chamber thereby plunging into the processing chamber through the processing container, the substrate to be processed is supported by the holder horizontally, and the holder is moved vertically to make the holder and the heating surface of the heater close to and apart from each other relatively.

According to an invention, the flowing direction of the processing fluid in a processing chamber is generally perpendicular to the close-and-apart moving direction of the holder and the heating surface of the heater.

According to an invention, the processing fluid is supplied so as to diffuse in the plane direction of the substrate arranged in the processing container and further bypass in a direction generally perpendicular to a diffusing surface of the substrate.

According to an invention, a substrate processing apparatus comprises: a processing container for accommodating a substrate to be processed, the processing container having a supply port for supplying a processing fluid into the processing container; holder for holding the substrate in the processing container; heater provided to the processing container for heating the substrate to a predetermined temperature; a supply pipeline connected to the supply port; valve interposed in the supply pipeline; a processing fluid source for supplying the processing fluid into the processing container through the supply pipeline; close-and-apart moving mechanism for moving the substrate held by the holder close to or apart from a heating surface of the heater relatively; and controller for controlling the close-and-apart motion of the close-and-apart moving mechanism and the open-and-close operation of the valve.

According to an invention, the substrate processing apparatus further comprises a connecting member arranged outside the processing container, wherein the holder includes a plurality of holding rods arranged so as to penetrate the processing container movably in a fluid-tight manner through a through-hole formed in the processing container and project into the processing container; and holding members arranged at respective tips of the holding rods to support the underside of the periphery of the substrate thereby holding it horizontally, and wherein the holding rods are connected, at their parts outside the processing container, with the close-and-apart moving mechanism through the connecting member.

According to an invention, each of the holding members has a holding part for supporting the lower surface of the periphery of the substrate and a standing part formed to stand upwardly from the outer portion of the holding part over the upper surface of the substrate, the standing part having an inside surface inclined to the holding part so as to gradually reduce a thickness between the inside surface of the standing part and the outer circumference of the standing part as directing upward.

According to an invention, the close-and-apart moving mechanism includes a motor rotatable in both direction and a ball screw mechanism having a converting part to convert the rotational movement of the motor to a linear movement.

According to an invention, the controller controls the close-and-apart moving mechanism in a manner that the substrate to be processed moves to a delivery position where the substrate is delivered into the processing container, an adjacent position where the substrate is opposed to the heating surface of the heater and a processing position where the substrate is apart from the heating surface of the heater over the adjacent position, and further controls the opening-and-closing operation of the valve in the supply pipeline in order to supply the substrate at the processing position with the processing fluid.

According to an invention, the controller further controls the close-and-apart moving mechanism in a manner that the substrate at the processing position moves close to and apart from the heating surface of the heater intermittently or continuously.

According to an invention, the processing container has a container body and a lid body, the heater is arranged in a horizontal bottom part of the container body forming the heating surface, the processing container has a fluid supply port and a drain port formed at opposing parts of a sidewall standing from the periphery of the horizontal bottom part, and the lid body is movable up and down in the vertical direction and also adapted so as to close an opening of the container body through a seal member.

According to an invention, the processing container includes a container body having its horizontal bottom part provided with the heater to form the heating surface, the container body having a fluid supply port and a drain port for the processing fluid, and a lid body that is movable up and down and is adapted so as to close an opening of the container body through a seal member, and the moving of the substrate between the adjacent position and the processing position is carried out under condition that the container body is closed by the lid body.

According to an invention, the processing container has a communication path to communicate the fluid supply port with the interior of the processing container, the communication path having a bypass part having a diffusion groove extending from the fluid supply port to both sides thereof and a sagging piece plunging into the diffusion groove.

According to an invention, the lid body further includes another heater.

According to the invention, by making the substrate to be processed approach the heating surface of the heater relatively and heating the substrate to the processing temperature while holding the substrate by the holder, it is possible to heat the substrate to the processing temperature in a short time. Then, after heating the substrate to the processing temperature, by separating the substrate from the heating surface of the heater to the processing position and further supplying the processing chamber of the processing container with the processing fluid, it is possible to supply the processing fluid uniformly. According to the inventions, by relatively moving the holder and the heating surface of the heater close to and apart from each other intermittently or continuously while supplying the processing chamber with the processing fluid, it is possible to make smooth approach of the processing fluid to both sides of the substrate and also possible to supply the processing fluid more uniformly.

Further, by moving the holder and the heating surface of the heater closer and farther in a direction generally perpendicular to the flowing direction of the processing fluid, it is possible to make the approach of the processing fluid to both sides of the substrate smoother. According to the inventions, by diffusing the processing fluid in the plane direction of the substrate in the processing container and further bypassing the processing fluid in a direction generally perpendicular to a diffusing surface of the substrate, it is possible to supply the substrate with the processing fluid uniformly.

Further, the processing container comprises the container body having its horizontal bottom part provided with the heater to form the heating surface, the container body having the fluid supply port and the drain port for the processing fluid, and the lid body that is movable up and down in the vertical direction of the substrate processing apparatus and is adapted so as to close an opening of the container body through the seal member, and the moving of the substrate between the adjacent position and the processing position is carried out under condition that the container body is closed by the lid body. Consequently, the withdrawal of the lid body from the container body allows the substrate to be transferred from the outside to the holder with ease. When processing the substrate, it is possible to insulate the processing chamber from the outside by closing the opening of the container body by the lid body closes through the seal member and also possible to process the substrate by heating it in a leak-tight atmosphere. In this case, since the lid body further comprises another heater, it is possible to maintain the processing temperature in the processing container more uniformly.

DESCRIPTION OF THE PREFERRED EMBODIMENT

Based on the attached drawings, embodiments of the present invention will be described below, in detail. Here, the substrate processing apparatus of the invention is applied to a substrate processing unit that is constructed so as to perform both resist solubilizing operation (ozone treatment or ozonation) and cleaning operation against the surface of a wafer.

Figure 1:
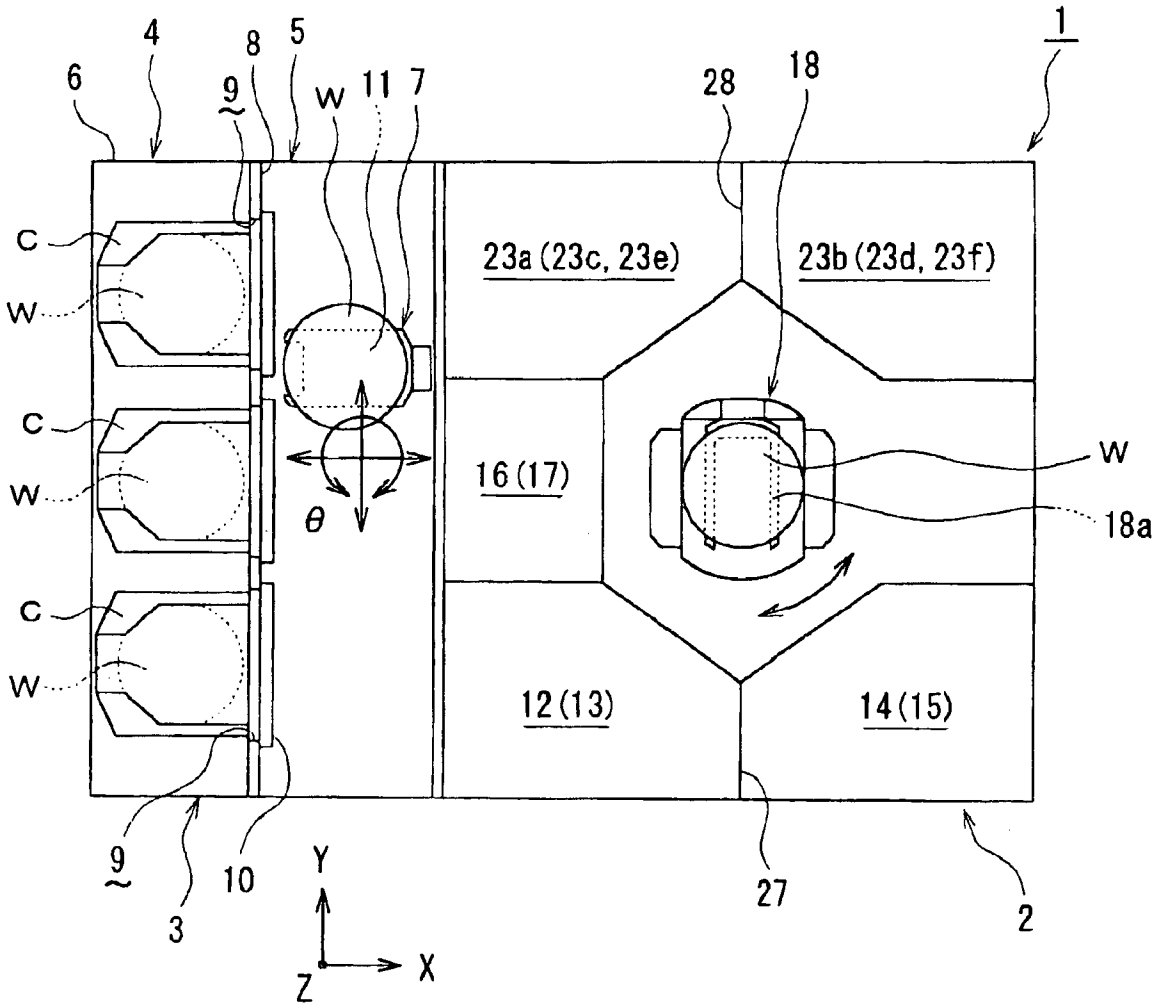
FIG. 1 is a schematic plan view showing a semiconductor wafer processing system to which the substrate processing apparatus of the present invention is applied.
Figure 2:
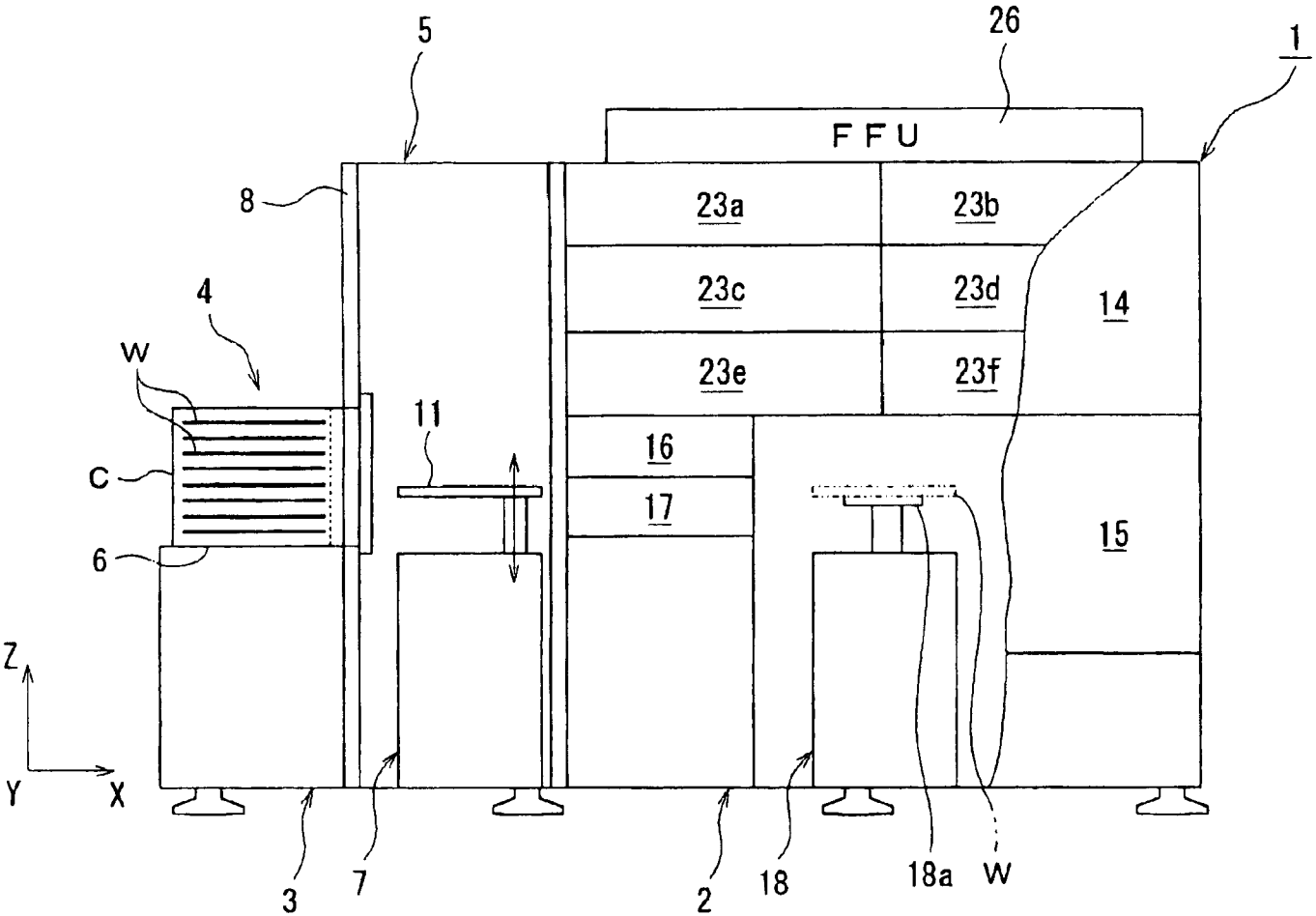
FIG. 2 is a schematic side view showing part of the substrate processing apparatus in section.

FIG. 1 is a plan view of a substrate processing system having a plurality of substrate processing units. FIG. 2 is a schematic side view of part of the processing system in section.

The substrate processing system 1 mainly includes a processing part 2 for processing substrates to be processed, for example, semiconductor wafers W and a loading/unloading part 3 for loading and unloading the wafers W to and from the processing part 2. Note, the semiconductor wafer(s) W will be referred "wafer(s) W", hereinafter.

The loading/unloading part 3 comprises one or more wafer carriers C each accommodating a plurality of wafers W (e.g. twenty five wafers) before and after processing, an in/out port 4 having a mounting table 6 for mounting the wafer carriers C thereon and a wafer transfer part 5 equipped with a wafer transfer unit 7 for carrying out the delivery of wafer between the wafer carrier C mounted on the mounting table 6 and the processing part 2.

On the side of the wafer carrier C, an openable-and-closable lid body is arranged. While the lid body is opened, the wafer W is transferred to and from the wafer carrier C through its side. The wafer carrier C is provided, on its inner wall, with a plurality of (e.g. twenty five) shelf plates for retaining the wafers W at predetermined intervals to define twenty-five slots for accommodating the wafers W therein. It is noted that these wafers W are accommodated in the slots, one by one, while directing their wafer surfaces for forming semiconductor devices thereon upwardly.

The mounting table 6 of the in/out port 4 is formed so as to mount a plurality of wafer carriers, for example, three wafer carriers C arranged at designated positions in a direction Y on the horizontal plane of the table 6. On the mounting table 6, each wafer carrier C is mounted so that its side face with the lid body faces a boundary wall 8 between the in/out port 4 and the wafer transfer part 5. The boundary wall 8 is provided, at positions corresponding to respective mounting positions of the wafer carriers C, with windows 9. On each window's side facing the wafer transfer part 5, there is arranged a window opening mechanism 10 that opens and closes the corresponding window 9 by means of a shutter etc.

In the wafer transfer part 5, the wafer transfer unit 7 is constructed so as to be movable in both horizontal Y-direction and vertical Z-direction and also rotatable in a plane of X-Y (θ-direction). The wafer transfer unit 7 includes a pickup/accommodating arm 11 for grasping the wafer W. The pickup/accommodating arm 11 is slidable in the X-direction. In this way, the wafer transfer unit 7 is capable of access to any slot (at any height) in all the wafer carriers C on the mounting table 6 and also access to two upper and lower wafer delivery units 16, 17 in the processing part 2, allowing the wafer W to be transferred from the in/out port 4 to the processing part 2, and vice versa.

The processing part 2 includes a main wafer transfer unit 18, the above wafer delivery units 16, 17 that temporarily mount the wafer W to transfer it to and from the wafer transfer part 5, a plurality of (e.g. six) ozone treatment units 23*a* to 23*f* as the substrate processing apparatus of the invention and a plurality of (e.g. four) substrate cleaning units 12, 13, 14, 15.

Further, in the processing part 2, there are an ozone gas processing unit (not shown) equipped with an ozone gas generator 42 for generating a processing gas, for example, ozone gas to be supplied to the ozone treatment units 23*a* to 23*f* and a chemical storage unit (not shown) for storing a designated processing liquid for the substrate cleaning units 12, 13, 14, 15. On the ceiling part of the processing part 2, a fan filter unit (FFU) 26 is provided to supply fresh air toward the above units and the main wafer transfer unit 18 downwardly.

Part of the downflow from the above fan filter unit (FFU) 26 flows to the wafer delivery units 16, 17 and also the wafer transfer part 5 through a space above the units 16, 17. As a result, the above flow of fresh air prevents particles etc. from invading from the wafer transfer part 5 into the processing part 2, establishing cleanness in the processing part 2.

Repeatedly, both of the wafer delivery units 16, 17 are adapted so as to mount the wafer W thereon temporarily for the delivery of the wafer W between the units 16, 17 and the wafer transfer part 5. These wafer delivery units 16, 17 are stacked up in two stages up and down. For instance, the wafer delivery unit 17 on the lower stage may be utilized to mount the wafer W in the process of its transportation from the in/out port 4 to the processing part 2. Then, the wafer delivery unit 16 on the upper stage is utilized to mount the wafer W in the process of its transportation from the processing part 2 to the in/out port 4.

The main wafer transfer unit 18 is constructed so as to be movable in both horizontal Y-direction and vertical Z-direction and also rotatable in the plane of X-Y (θ-direction) by a not-shown motor. The main wafer transfer unit 18 is equipped with one or more transfer arms 18*a* for holding the wafer W. The transfer arm 18*a* is slidable in the Y-direction. The so-constructed main wafer transfer unit 180 is capable of access to all of the wafer delivery units 16, 17, the substrate cleaning units 12, 13, 14, 15 and the ozone treatment units 23*a* to 23*f*. Again, the main wafer transfer unit 18 is electrically connected to appropriate controller, for example, a CPU in order to allow the wafers W to be transferred to the ozone treatment units 23*a* to 23*f* in sequence.

The substrate cleaning units 12, 13, 14, 15 are formed to each wash and dry the wafer W after later-mentioned resist solubilizing process (ozone processing) thereby removing the resist film from the wafer W. Additionally, the same units 12, 13, 14, 15 are capable of subsequent cleaning with chemical liquid and drying of the wafer W.

As shown in FIG. 1, the substrate cleaning units 12, 13 and the substrate cleaning units 14, 15 have structures in symmetry with each other on both sides of a wall 27 as the boundary of symmetry. Except this symmetrical arrangement, the substrate cleaning units 12, 13, 14, 15 are provided with similar structures.

On the other hand, the ozone treatment units 23*a* to 23*f* each perform to solubilize resist applied on the surface of the wafer W. The ozone treatment units 23*a* to 23*f* are arranged in three stages vertically and two units for each stage horizontally, as shown in FIG. 2. On the left stage, there are arranged the ozone treatment units 23*a*, 23*c*, 23*e* in order from above. While, on the right stage, there are arranged the ozone treatment units 23*b*, 23*d*, 23*f* in order from above. As shown in FIG. 1, the ozone treatment units 23*a* and 23*b*, the ozone treatment units 23*c* and 23*d*, and the ozone treatment units 23*e* and 23*f* in respective pairs have structures in symmetry with each other on both sides of a wall 28 as the boundary of symmetry. Except this symmetrical arrangement, the ozone treatment units 23*a* to 23*f* are provided with similar structures. Therefore, as a representative of these processing units, the structure of the ozone treatment unit 23*a* will be mainly described below, in detail.

[1st. Embodiment]

Figure 3:
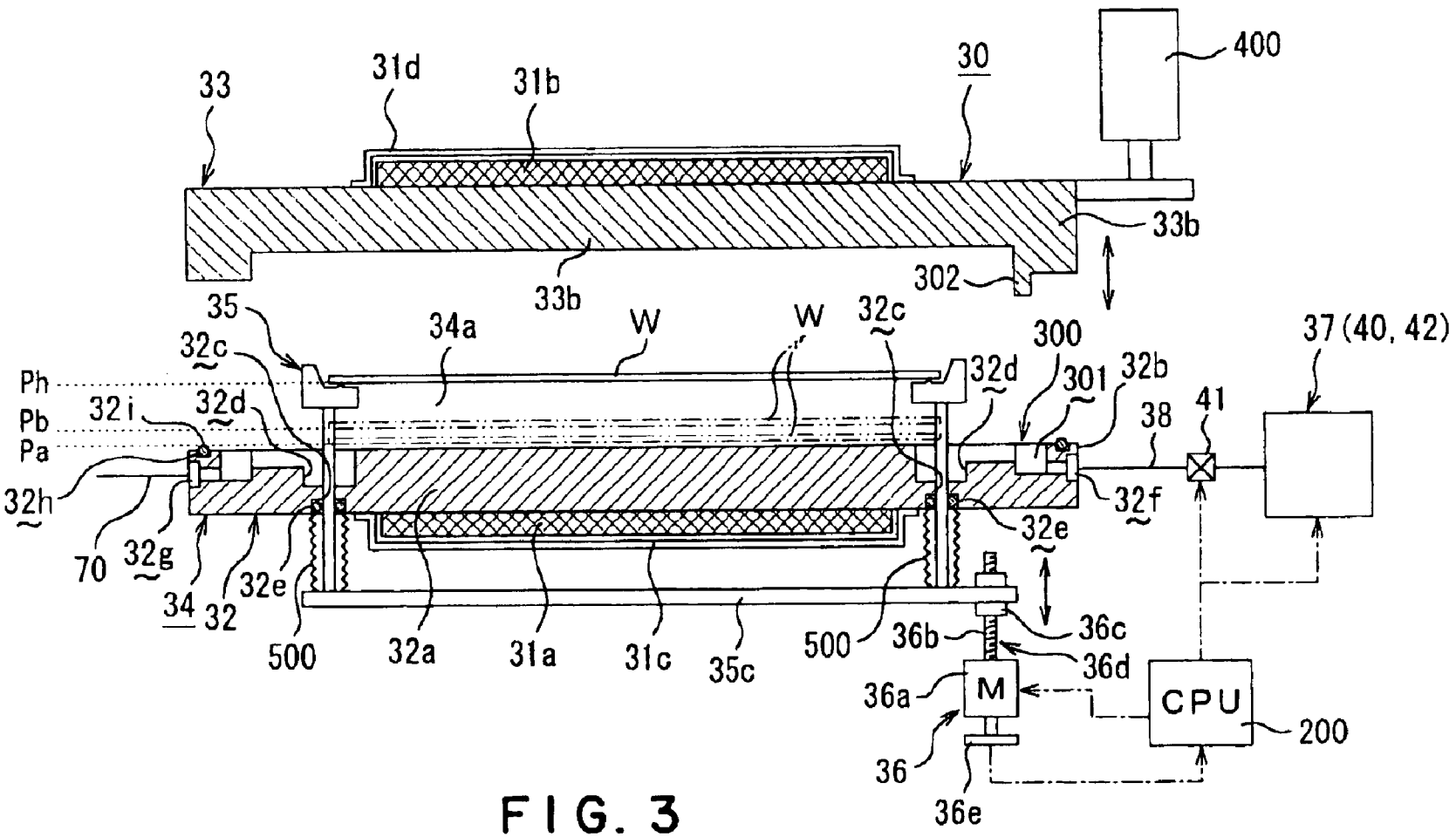
FIG. 3 is an exploded sectional view of the substrate processing apparatus in accordance with the first embodiment of the present invention.

As shown in FIG. 3, an ozone treatment apparatus 30 forming the above ozone treatment unit 23*a* mainly comprises a processing container 34 formed by a processing container body 32 (referred "container body 32") having heater 31 and also accommodating a wafer W, a rid body 33 covering the container body 32 to define a processing chamber 34*a* together with the body 32, holding unit 35 penetrating the container body 32 into the processing chamber 34*a* to hold the wafer W horizontally, the holding unit 35 capable of forward-and-backward movements, moving means 36 for vertically moving the holding unit 35 to and from a horizontal bottom part 32*a* of the container body 32 and a processing fluid source 37 for supplying ozone and vapor (as the processing fluid) into the processing chamber 34*a*.

Figure 6A:
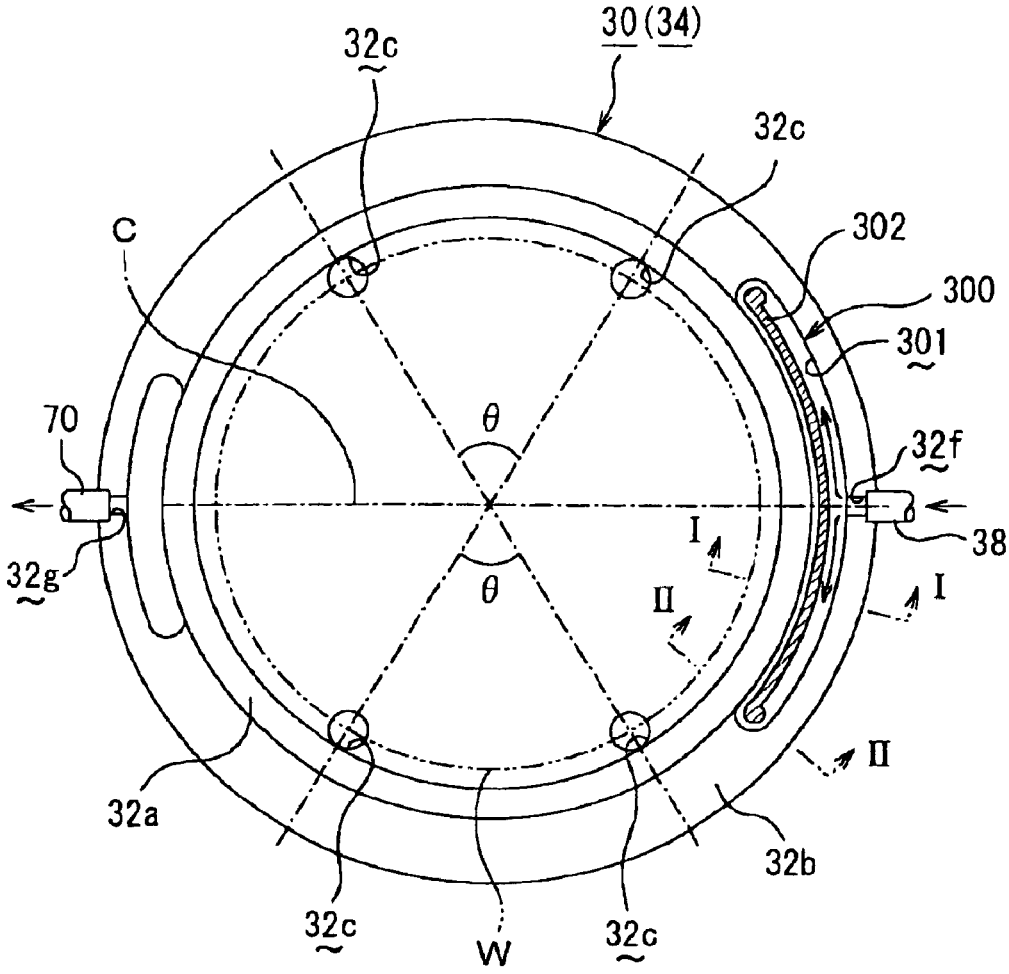
FIG. 6A is a plan view showing holding rods of the holding unit and the communication path.

As shown in FIGS. 3 and 6A, the container body 32 includes the plate-shaped horizontal bottom part 32*a* and a sidewall 32*b* standing on the outer side of the horizontal bottom part 32*a*. The container body 32 is formed so as to be rich in ozone resistance by coating silicon oxide (SiO2) film or fluorocarbon resin film on, for example, a stainless-steel member.

The horizontal bottom part 32*a* is provided, at four positions on the same circumference, with four through-holes 32*c* through which holding rods 35*a* forming the later-mentioned holding unit 35 penetrate. The holding rods 35*a* are arranged so as to be movable in the through-hole 32*c* through seal members, for example, O-rings 32*e* in a leak-tight manner. Note, on the upper side of each through-hole 32*c*, an expanded diameter part 32*d* is formed to accommodate a holding member 35*b* of the holding unit 35.

Figure 8A:
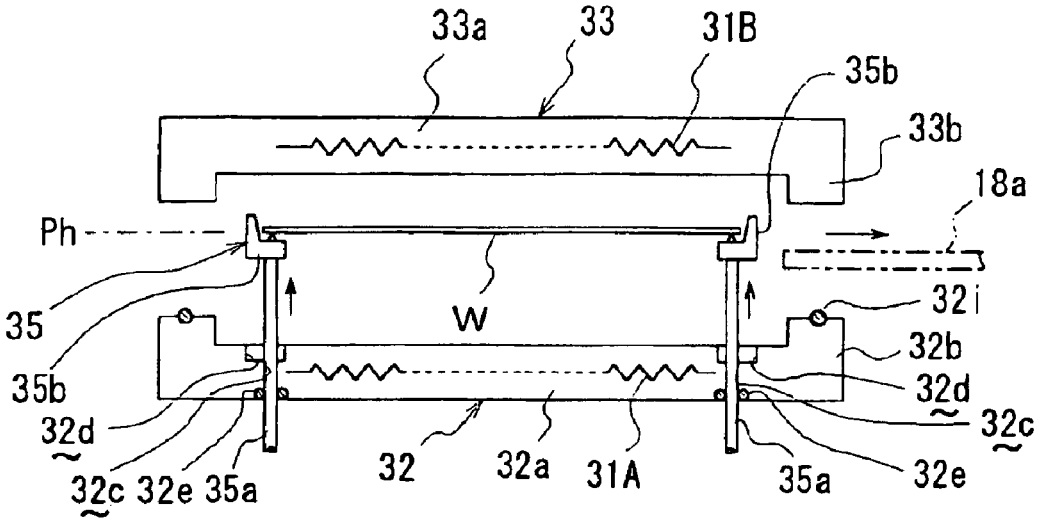
FIGS. 8A, 8B and 8C are explanatory views explaining the substrate processing method of the first embodiment.
Figure 8B:
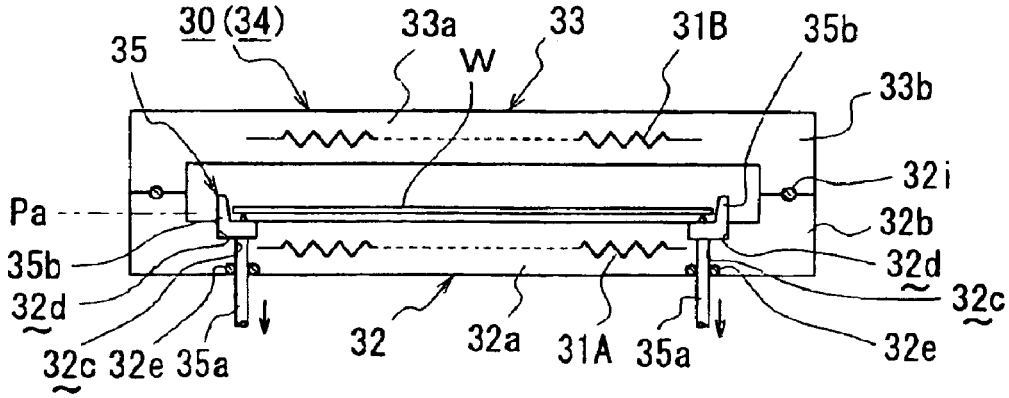
Figure 8C:
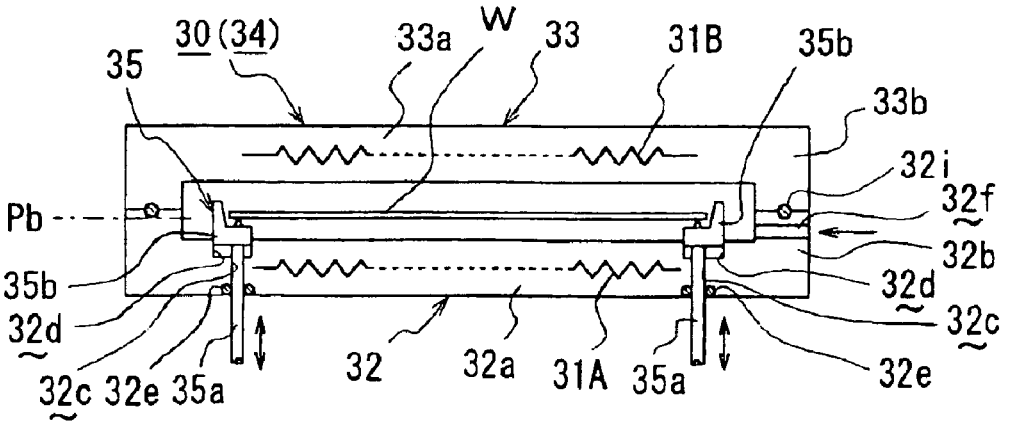
Figure 9:
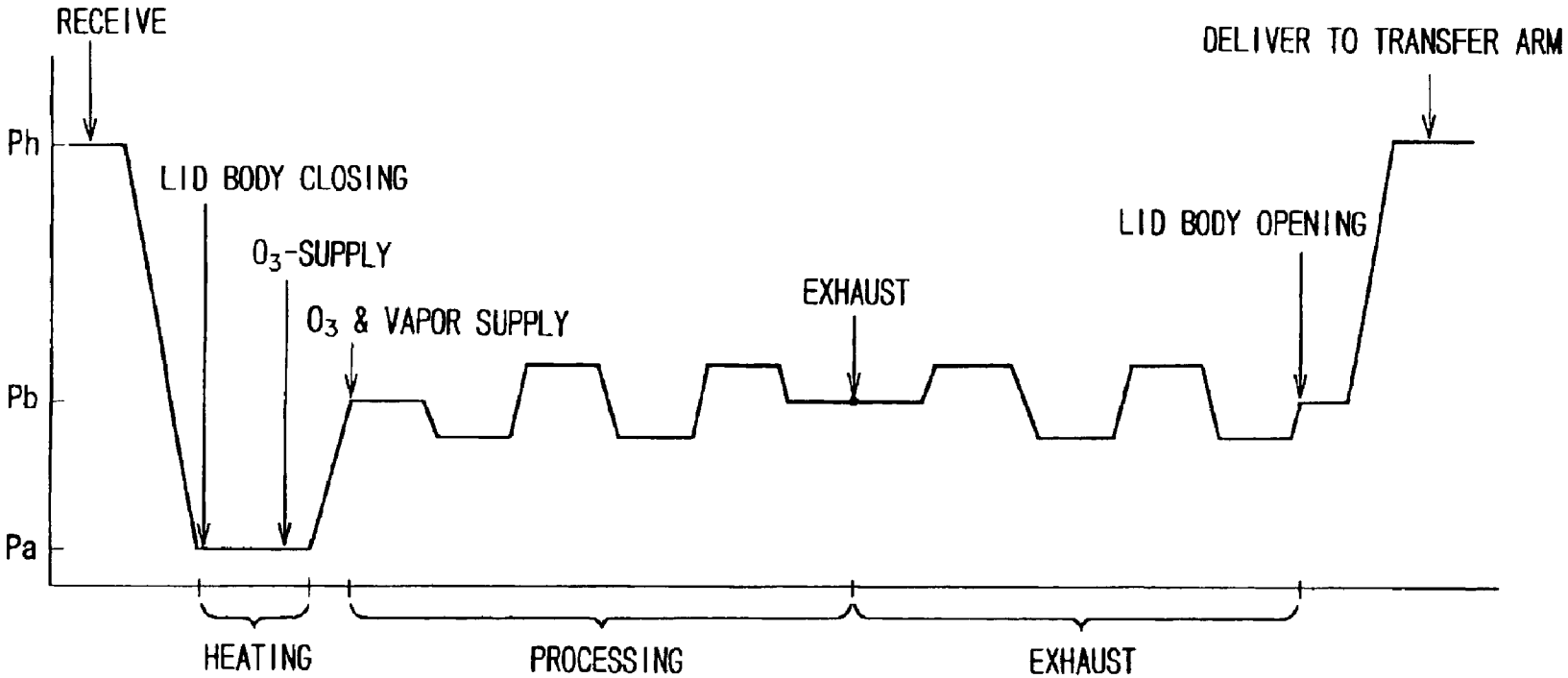
FIG. 9 is a timing chart showing the relationship between processing steps and a gap between the substrate to be processed and heater in the substrate processing method of the invention.

A flat-type heater 31*a* as the heater is fixed to the lower surface of the horizontal bottom part 32*a* closely. The flat-type heater 31*a* is covered with an outer cover 31*c*. In this way, since the heater 31*a* is fixed to the lower surface of the horizontal bottom part 32*a* closely, it constitutes the heating surface of the heater. Noted that the flat-type heater 31*a* may be replaced by a heater 31A (see FIGS. 8A, 8B and 8C) embedded in the horizontal bottom part 32*a* of the container body 32. Thus, owing to the provision of the heater 31*a* (or 31A), it is possible to heat the atmosphere in the processing chamber 34*a* and the wafer W up to a designated processing temperature, for example, about 100° C.

Additionally, the sidewall 32*b* is provided, at opposing positions about the center of the container body 32, with a supply port 32*f* for introducing the processing fluid into the processing chamber 34*a* and a drain port 32*g* for discharging the fluid from the chamber 43*a*. The supply port 32*f* and the drain port 32*g* are connected to a supply pipeline 38 and a drain pipeline 70, respectively.

On the top of the sidewall 32*b*, a circumferential groove 32 is formed to fit an O-ring 32*i* therein. Owing to the provision of the O-ring 32*i*, it is possible to bring the upper surface of the peripheral part of the horizontal bottom part 32*a* into close contact with the lower surface of a sagging wall 33*b* of the later-mentioned lid body 33, whereby the processing chamber 34*a* can be sealed up.

Figure 6B:
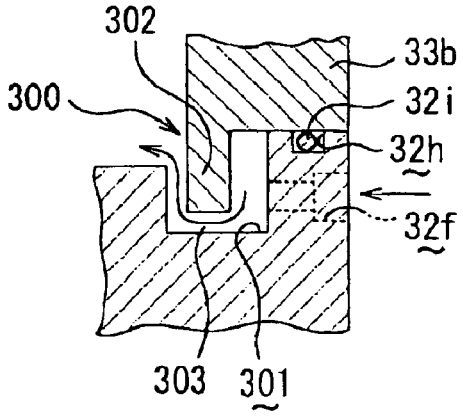
FIG. 6B is an enlarged sectional view taken along a line I—I of FIG. 6A
Figure 6C:
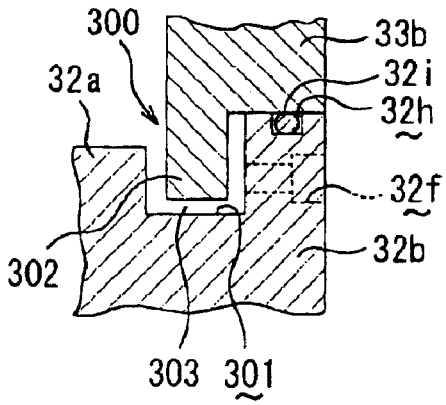
FIG. 6C is an enlarged sectional view taken along a line II—II of FIG. 6A.

Further, the container body 32 is provided with a communication path 300 that communicates the supply port 32*f* with the interior of the processing chamber 34*a*. As shown in FIGS. 6A, 6B and 6C, the communication path 300 includes a bypass part 303 consisting of a diffusion groove 301 extending from the supply port 32*f* to both sides of the port 32*f* and a sagging piece 302 plunging from the lower surface of the sagging wall 33*b* into the diffusion groove 301. In this way, owing to the formation of the communication path 300 between the supply port 32*f* and the processing chamber 34*a*, it is possible to diffuse the processing fluid supplied into the processing chamber 34*a* through the supply port 32*f*, that is, mixture fluid of ozone and vapor, in the form of a substantial-horizontal plane and also possible to bypass the processing fluid to a direction perpendicular to the diffusing surface of the wafer W. Therefore, it is possible to supply all over the processing chamber 34*a* with the mixture fluid of ozone and vapor, allowing it to be supplied to the wafer W uniformly.

The lid body 33 is mainly formed by a disk-shaped base 33*a* and a sagging wall 33*b* extending from the lower surface of the periphery of the base 33*a*. The above sagging piece 302 is formed to project from the sagging wall 33*b* at its position opposing the groove 301. Similarly to the container body 32, the lid body 33 is formed by a stainless steel member, for example. At the interior of the processing chamber 34*a*, its lower surface is coated with silicon oxide (SiO2) film or fluorocarbon resin film so that the lid body 33 is rich in ozone resistance. Further, another flat heater 31*b* as the heater is fixed to the top surface of the base 33*a* of the lid body 33 closely and further covered with an outer cover 31*d*. Noted that the heater 31*b* may be replaced by a heater 31B (see FIGS. 8A, 8B and 8C) embedded in the base 33*a*.

The so-formed lid body 33 is moved so as to approach and leave the container body 32, by elevating means, for example, a cylinder mechanism 400. With the movement of the lid body 33, the processing chamber 34*a* is sealed up on condition that the sagging wall 33*b* comes into close contact with the top of the sidewall of the container body 32. Note, the height of the interior of the processing chamber 34*a* is set to about 5 mm.

The holding unit 35 consists of a plurality of holding rods 35*a* and holding members 35*b* in pairs. Each of the holding rods 35*a* is arranged so as to penetrate a through-hole 32*c* formed in the processing container 32 in a fluid-tight manner. Projecting into the processing container 32, the holding rods 35*a* are adapted so as to movably support the wafer W horizontally. While, each of the holding members 35*b* is arranged at the tip of the holding rod 35*a* to support the underside of the periphery of the wafer W. The lower ends of the holding rods 35*a* outside the container body 32 are connected to a connecting member 35*c*. Through the intermediary of the connecting member 35*c*, the holding unit 35 is associated with close-and-apart moving mechanism (moving unit) 36. Note, the holding rods (parts) 35*a* projecting from the container body 32 downward are enveloped in expandable bellows 500 arranged between the lower surface of the container body 32 and the upper surface of the connecting member 35*c*. Each bellows 500 is provided with an exhaust port (not shown) connected with a not-shown exhaust system.

Figure 4:
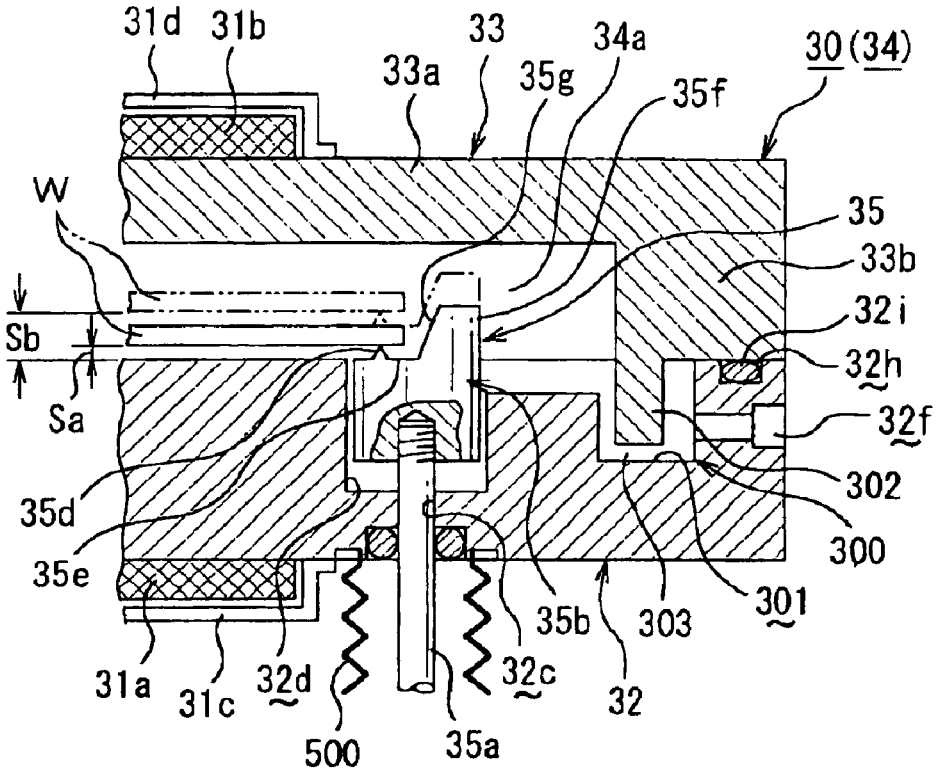
FIG. 4 is an enlarged sectional view of the essential part of the apparatus, showing holding unit and a communication path of the invention.
Figure 5:
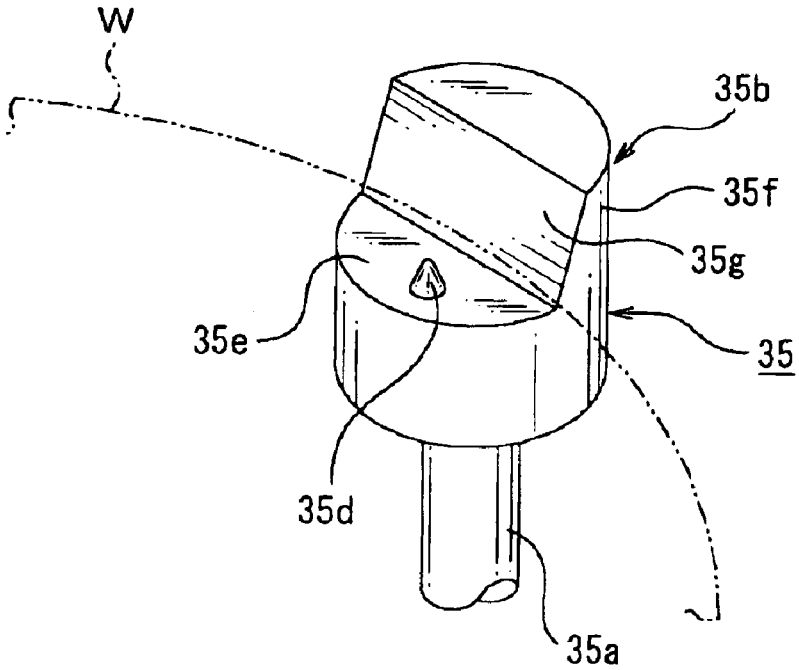
FIG. 5 is a perspective view showing a holding member of the holding unit of the first embodiment of the invention.

As shown in FIGS. 4 and 5, each of the holding members 35*b* includes a holding part 35*e* having a projection 35*d* for supporting the lower surface of the periphery of the wafer W and a standing part 35*f* standing from the outer portion of the holding part 35*e* upward of the upper surface of the wafer W. On the inner side of the standing part 35*f*, a tapered surface 35*g* is formed so as gradually reduce a thickness between the inside surface of the standing part 35*f* and the outer circumference of the standing part 35*f* as directing upward. The holding members 35*b* are made of corrosion-resisting and chemical-resisting synthetic resin softer than the processing container 34, for example, polyether ether ketone (PEEK) or fluorocarbon resin material.

As shown in FIG. 6A, four holding rods 35*a* forming the holding unit 35 are divided into two groups to left and right about the center line C connecting the supply port 32*f* with the drain port 32*g*. Additionally, on each side of the center line C, two holding rods 35*a* are arranged to form a sharp angle θ about the center of the container 34. Since four holding rods 35*a* are arranged around the center in the above way, it is possible to prevent the flow of the mixture fluid of ozone and vapor, which has been supplied into the processing chamber 34*a* through the supply port 32*f*, from being disturbed by the holding rods 35*a* and the holding members 35*b*. Additionally, so far as wafer holding portions of the transfer arm 18*a* to transfer a wafer W in a direction perpendicular to the center line C do not interfere with the holding rods 35*a* and the holding members 35*b*, it is possible to broaden a width between the wafer holding portions, as possible.

As shown in FIG. 3, the close-and-apart moving mechanism (moving unit) 36 is formed by a reversal motor 36*a* capable of normal and reverse rotations, such as step motor or servo-motor, and a ball screw mechanism 36*d*. The ball screw mechanism 36*d* has a converting part 36*c* in screw engagement with a screw shaft 36*b* connected to a drive shaft of the motor 36*a* through not-shown balls. Thus, the converting part 36*c* serves to convert the rotational movement of the reversal motor 36*a* to the linear movement. The motor 36*a* is electrically connected to controller, for example, a CPU 200. Thus, by control signals from the CPU 200, the motor 36*a* is rotated in normal and reverse to move the holding rods 35*a* of the holding unit 35 up and down. In other words, with the rotation of the motor 36*a*, the wafer W is moved close to and apart from the heating surface of the horizontal bottom part 32*a* of the container body 32. With the control of the CPU 220, the wafer W can stop at the following positions of: adjacent (pre-heating) position Pa (gap Sa: 0.2 to 0.5 mm) to make the wafer W close to the horizontal bottom part 32*a*; processing position Pb (gap Sa: 1 to 2 mm) to make the wafer W apart from the horizontal bottom part 32*a*; and delivery position Ph to elevate the wafer W furthermore. Further, at the processing position Pb, the CPU 200 controls the movement of the wafer W so that it approaches and leaves (oscillate) the horizontal bottom part 32*a* of the container body 32 intermittently or continuously. In this case, the rotation of the motor 36*a* is detected by a rotation detector, for example, an encoder 36*e*. Then, the detection signal is transmitted to the CPU 200 and further, the rotation of the motor 36*a* is controlled on the basis of the control signals from the CPU 200.

Additionally, the CPU 200 is electrically connected to valve 41. The valve 41 is interposed in a supply pipeline 38 connecting the supply port 32*f* in the processing container 34 with a processing fluid source 37.

Next, the piping system of the ozone treatment unit 23*a* will be described with reference to FIG. 7. Through the supply pipeline 30 for the processing fluid (referred "main pipeline 38" after) connected to the supply port 32*f* of the processing container 34, the ozone treatment unit 23*a* is connected to a vapor generator 40 as a solvent vapor source forming the processing fluid source. Through "fluid supply" switching means (unit) 41 as the valve, the ozone treatment unit 23*a* is further connected to the ozone gas generator 42 and a nitrogen source 43 both of which constitute the processing fluid source in cooperation with the vapor generator 40. The "fluid supply" switching means 41 includes a flow regulating valve 50 to perform both communication/blocking and flow control of the main pipeline 38, a flow regulating valve 52 to perform both communication/blocking and flow control of an ozone gas pipe 51 for supplying the processing chamber 34*a* with ozone gas produced in the ozone gas generator 42 and a switching valve 54 to perform communication/blocking of a nitrogen pipe 53 for supplying the processing chamber 34*a* with nitrogen gas ($N_2$) from the nitrogen source 43.

Figure 7:
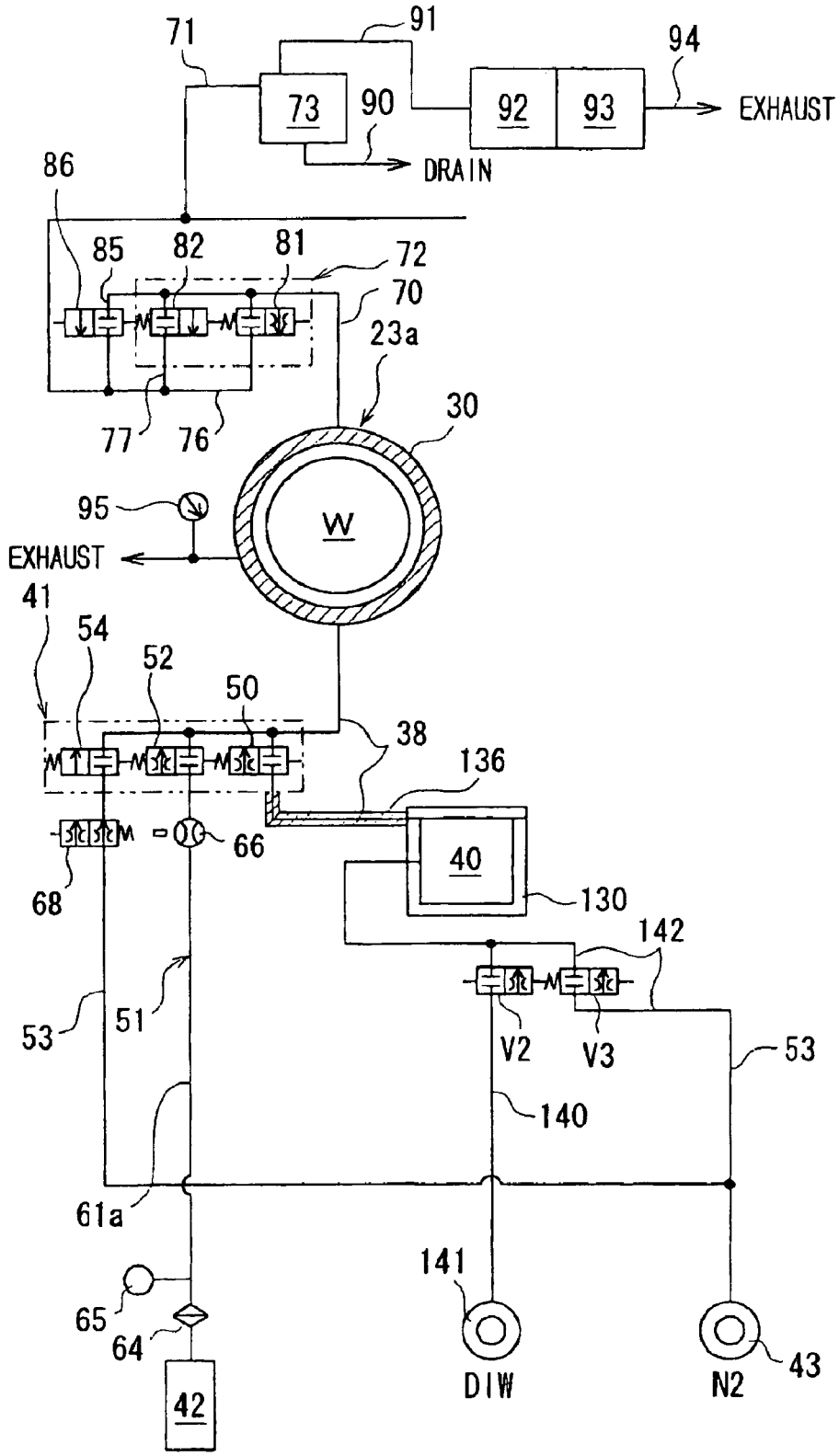
FIG. 7 is a schematic structural view showing a piping system of the substrate processing apparatus of the invention.

As shown in FIG. 7, the ozone gas pipe 51 is connected to the ozone gas generator 42. In the ozone gas pipe 51, there are a filter 64, an ozone concentration detector 65 for detecting a concentration of ozone ($O_3$) in the ozone gas produced by the ozone gas generator 42, a flow meter 66 for detecting the flow rate of ozone gas and the above flow regulating valve 52, in order from the side of the ozone gas generator 42.

In the flow regulating valve 52, the balance of controlled flow rate is previously established so that the flow rate detected by the flow meter 66 is always constant when the ozone gas is supplied into the processing chamber 34*a*.

As shown in FIG. 7, the nitrogen pipe 53 includes a flow switching valve 68 and the above switching valve 54 in order from the side of the nitrogen source 43. The flow switching valve 68 is formed so as to allow its valve position to be changed between a large-rate part and a small-rate part.

Further, by control the position of the large-rate part or the small-rate part of the flow switching valve 68 to adjust the balance of flow control value, it is possible to supply the processing chamber 34*a* with a predetermined flow rate of $N_2$-gas flowing from the nitrogen source 43 into the nitrogen pipe 53 and the sequent main pipeline 38. By controlling the flow regulating valve 50 to adjust the balance of flow control value, it is possible to supply the processing chamber 34*a* with a predetermined flow rate of vapor flowing from the vapor generator 40 into the main pipeline 38.

On the other hand, a drain pipeline 70 is connected to the drain port 32*g* opposing the connection of the main pipeline 38 with the processing chamber 34*a* of the processing container 34. The drain pipeline 70 is also connected to a mist trap 73 through an exhaust switching part 72 (as pressure regulating means) and another drain pipeline 71.

The exhaust switching part 72 includes a branch pipe 76 having a first exhaust-flow control valve 81 interposed therein to for exhaust of small amount when opened, and another branch pipe 77 having a second exhaust-flow control valve 82 interposed therein to for exhaust of large amount when opened. The downstream side of the valve 81 in the branch pipe 76 is united to the downstream side of the valve 82 in the branch pipe 77 to form the drain pipeline 71 again. Further, a branch pipe 85 is arranged to connect the upstream side of the valve 82 in the branch pipe 77 with the downstream side of the junction between the branch pipes 76, 77. In the blanch pipe 85, there is a third exhaust-flow control valve 83 that closes in the normal state and opens in an emergency, for example, situation that a pressure in the processing chamber 34*a* rises excessively.

The mist trap 73 operates to cool the discharged processing fluid and further separate it into gas containing ozone gas and liquid. Then, the liquid is discharged from the mist trap 73 through a drain pipe 90. While, the gas containing ozone gas is fed to an "ozone killer" 92 through an exhaust pipe 91. At the ozone killer 92, ozone-gas component in the gas is decomposed into oxygen thermally and further cooled down at a cooling unit 93. After cooling, the oxygen is discharged from the unit 93 through an exhaust pipe 94.

As mentioned above, the flow rate of vapor supplied to the processing chamber 34*a* is controlled by the flow control valve 50, while the flow rate of ozone gas supplied to the processing chamber 34*a* is controlled by the flow control valve 52. The atmosphere pressure of vapor, ozone gas, the mixture of vapor and ozone gas or the like in the processing chamber 34*a* is controlled since the exhaust switching part 72 controls the flow rate of exhaust gas from the processing chamber 34*a*.

Note, the processing chamber 34*a* is provided with a leak sensor 95 to monitor a leakage of the processing fluid in the chamber 34*a*.

As shown in FIG. 7, the vapor generator 40 is constructed to generate vapor by heating deionized water (DIW) stored in a tank 130 by means of not-shown heater. Then, the inside temperature of the tank 130 is controlled at about 120° C. and the inside pressure is maintained in a pressurized state. The main pipeline 38 is provided, between the vapor generator 40 and the "fluid supply" switching means 41, with a tubular heat regulator 136 along the contour of the pipeline 38. As a result, the vapor fed from the vapor generator 40 can be controlled in temperature while flowing through the main pipeline 38 for the "fluid supply" switching means 41.

A flow control valve V2 is interposed in a pure water pipe 140 for supplying the tank 130 with deionized water (pure water). The pure water pipe 140 is connected to a pure water source 141. Further, the pure water pipe 140 is connected, on the downstream side of the valve V2, to a nitrogen source 43 through a branch pipe 142 separated from the nitrogen pipe 53. The branch pipe 142 includes a flow control valve V3. The communicating and blocking operations of the flow control valves V2, V3 are synchronized to each other.

Next, the substrate processing method of the present invention will be described with reference to FIGS. 8A, 8B, 8C and 9. First, by the pickup/accommodating arm 11, the wafers W are taken out of the carrier C mounted on the mounting table 6, one by one. The wafer W taken out by the arm 11 is transferred to the wafer delivery unit 17. Then, the main wafer transfer unit 18 receives the wafer W and further loads it to each of the ozone treatment units 23*a* to 23*f* in sequence.

In detail, the wafers W are loaded into the processing containers 34 of the ozone treatment units 23*a* to 23*f* while being carried by the transfer arm 18*a* of the main wafer transfer unit 18. At this time, on condition of separating the lid body 33 from the container body 32 defining the processing chamber 34*a*, the transfer arm 18*a* of the main wafer transfer unit 18 moves to the underside of the lid body 33. Then, the holding members 35*b* of the holding unit 35 are moved upward by the close-and-apart moving mechanism 36 to receive the wafer W from the transfer arm 18*a* (see FIG. 8A). Next, with the driving of the close-and-apart moving mechanism 36, the holding members 35*b* are lowered to approach the horizontal bottom part 32*a* of the container body 32. Further, the lid body 33 is lowered to make the sagging wall 33*b* in abutment with the top surface of the sidewall 32*b* of the container body 32 while applying a pressure on the O-ring 32*i*. In this way, the container body 32 is sealed up (see FIG. 8B). In this state, a gap Sa (about 0.2 to 0.5 mm) is produced between the lower surface of the wafer W and the surface of the horizontal bottom part of the container body 32. On the establishment of the gap Sa, the heater 31A is turned on electricity for about 30 sec., so that the wafer W is heated up to about a processing temperature (e.g. 100° C.) (preheating process). Consequently, it is possible to promote the resist solubilizing process (ozone processing) of the wafer W.

When the wafer W in the processing chamber 34*a* is heated sufficiently, the information is transmitted to the CPU 200. Then, the CPU 200 transmits a signal for starting the supply of ozone gas to the processing container 34*a*. The ozone gas supplied to the processing chamber 34*a* is controlled in terms of both its flow rate and ozone concentration since the CPU 200 controls massflow controllers 188, 191 and the ozone gas generator 42. First, based on the opening/closing state of the flow control valve 52, the flow control values of the massflow controllers 188, 191 are controlled by the CPU 200, so that the whole flow rate of oxygenic gas supplied to the ozone gas generator 42 is controlled. Additionally, a feedback system having the CPU 200, the ozone gas generator 42 and the ozone-concentration detector 65 allows the ozone concentration to be adjusted at a designated value in feedback control.

The flow control valve 52 is opened by a signal from the CPU 200, so that the ozone gas of a designated concentration is supplied from the ozone gas generator 42 to the processing chamber 34*a* through an ozone-gas main pipe 60, an ozone-gas branch pipe 61, the flow control valve 52 and the main pipeline 38. The processing chamber 34*a* is supplied with the ozone gas having a flow rate corresponding to a flow control value of the flow control valve 52. Note, the flow control value of the flow control valve 52 is previously adjusted in balance with the flow control valve 52. Further, under condition of opening the first exhaust-flow control valve 81 of the exhaust switching part 72, the flow rate of the exhaust gas from the processing chamber 34*a* to the exhaust pipeline 70 is controlled by the first exhaust-flow control valve 81. In this way, by supplying the ozone gas while exhausting the processing chamber 34*a* through the exhaust pipeline 70, the ozone-gas atmosphere is formed in the processing chamber 34*a* while maintaining a constant pressure in the chamber 34*a*. In this case, the pressure in the processing chamber 34*a* is maintained higher than the atmospheric pressure, for example, about 0.2 Mpa in gauge pressure. Further, owing to the provision of the heaters 31*a*, 31*b*, the atmosphere in the processing chamber 34*a* and the temperature of the wafer W are unchangeable together. The atmosphere discharged from the processing chamber 34*a* through the exhaust pipeline 70 is introduced into the mist trap 73. In this way, the processing chamber 34*a* is filled up with the ozone gas of a predetermined concentration (ozone-gas charging process).

After charging the ozone gas, the motor 36*a* of the close-and-apart moving mechanism 36 is driven to raise the holding rods 35*a* of the holding unit 35. As a result, the holding members 35*b* and the wafer W are moved to a processing position Pb (gas Sb=1 to 2 mm) apart from the surface of the horizontal bottom part (see FIG. 8C). At the same time of this operation, the supply chamber 34*a* is supplied with the mixture fluid of ozone gas and vapor, thereby performing the resist solubilizing process (ozone treatment) of the wafer W (ozone treatment process). Then, owing to the provision of the diffusion groove 301 of the communication path 300, the mixture fluid of ozone gas and vapor, which has been supplied into the processing chamber 34*a* through the supply port 32*f*, is diffused horizontally in the chamber 34*a*. Additionally, owing to the formation of the bypass part 303, the mixture fluid flows into the processing chamber 34*a* while making a detour in a direction perpendicular to the horizontal direction of diffusion. Consequently, the mixture fluid is introduced into the processing chamber 34*a* while covering its wide area, so that the wraparound of the mixture fluid against the processed surface of the wafer W can be effected smoothly. Further, by driving the motor 36*a* of the close-and-apart moving mechanism 36 in normal and reverse rotations continuously or intermittently, it may be carried out to allow the wafer W to approach and leave the surface of the horizontal bottom part during the ozone treatment. Then, the wraparound of the mixture fluid against both surfaces of the wafer W can be effected more smoothly to progress the uniformity in processing.

Next, by opening the first exhaust-flow control valve 81 of the exhaust switching part 72 interposed in the exhaust pipeline 70, it is carried out to discharge the mixture fluid (ozone gas, vapor) from the processing chamber 34*a*. In connection, by driving the motor 36*a* of the close-and-apart moving mechanism 36 in normal and reverse rotations continuously or intermittently, it may be carried out to allow the wafer W to approach and leave the surface of the horizontal bottom part. Note, new mixture fluid consisting of ozone gas and vapor may be introduced into the processing chamber 34*a* during the discharging operation of the mixture fluid. In this case as well, the pressure in the processing chamber 34*a* is maintained higher than the atmospheric pressure, for example, the order of 0.2 MPa in gauge pressure. Additionally, the atmosphere in the processing chamber 34*a* and the temperature of the wafer W are together maintained by the heaters 31*a*, 32*b*. In this way, the resist coated on the surface of the wafer W is oxidized by the mixture fluid of ozone gas and vapor filled in the processing chamber 34*a* (resist solubilizing process).

On completion of the designated resist solubilizing process (ozone treatment), the flow control valves 50, 52 in the main pipeline 38 are together closed at first and the switching valve 54 is opened, while the flow switching valve 68 is operated to occupy the position of the large-rate part to supply the processing chamber 34*a* with a large quantity of nitrogen from the nitrogen source 43. Further, the second exhaust-flow control valve 82 of the exhaust switching part 72 in the exhaust pipeline 70 is opened. Then, nitrogen gas is supplied from the nitrogen source 43 while exhausting the processing chamber 34*a*. As a result, it is possible to purge the main pipeline 38, the processing chamber 34*a* and the exhaust pipeline 70 with nitrogen. The discharged ozone gas is introduced into the mist trap 73 through the exhaust pipeline 70. In this way, the mixture fluid of ozone gas and vapor is discharged from the processing chamber 34*a* (discharging process).

Subsequently, the cylinder mechanism (the elevating means) 400 is operated to move the lid body 33 upward. Next, the motor 36*a* of the close-and-apart moving mechanism 36 is driven to elevate the holding members 35*b* of the holding unit 35 to the delivery position Ph. In this state, it is carried out to move the transfer arm 18*a* of the main wafer transfer unit 18 to the underside of the wafer W. Then, the transfer arm 18*a* receives the wafer W held by the holding members 35*b* and further takes the wafer W out of the processing chamber 34*a* (wafer unloading process).

Note, by the main wafer transfer unit 18, a new wafer W is loaded into the processing chamber 34*a* where the resist solubilizing process (ozone treatment) is performed as well.

Further, the wafers W are loaded into the ozone treatment units 23*b* to 23*f* in sequence to perform the resist solubilizing process (ozone treatment). Then, if the resist solubilizing process (ozone treatment) is carried out by two ozone treatment units 23*a*, 23*b*, both of the massflow controllers 188, 191 are controlled by the CPU 200. Thus, the flow (quantity) of ozone gas generated by the ozone gas generator 42 is adjusted so as to be equal to a flow rate for two units to be consumed in the ozone treatment units 23*a*, 23*b*. Also, if the resist solubilizing process (ozone treatment) is carried out by three or four ozone treatment units, both of the massflow controllers 188, 191 are controlled by the CPU 200. Thus, the flow (quantity) of ozone gas generated by the ozone gas generator 42 is adjusted so as to be equal to a flow rate for three or four units to be consumed in the ozone treatment units.

The wafer W subjected to the resist solubilizing process (ozone treatment) at the ozone treatment units 23*a* to 23*f* are successively transferred to the substrate cleaning units 12 to 15 where a cleaning process and the sequent drying process are applied to the wafers W respectively.

[2nd. Embodiment]

Figure 10:
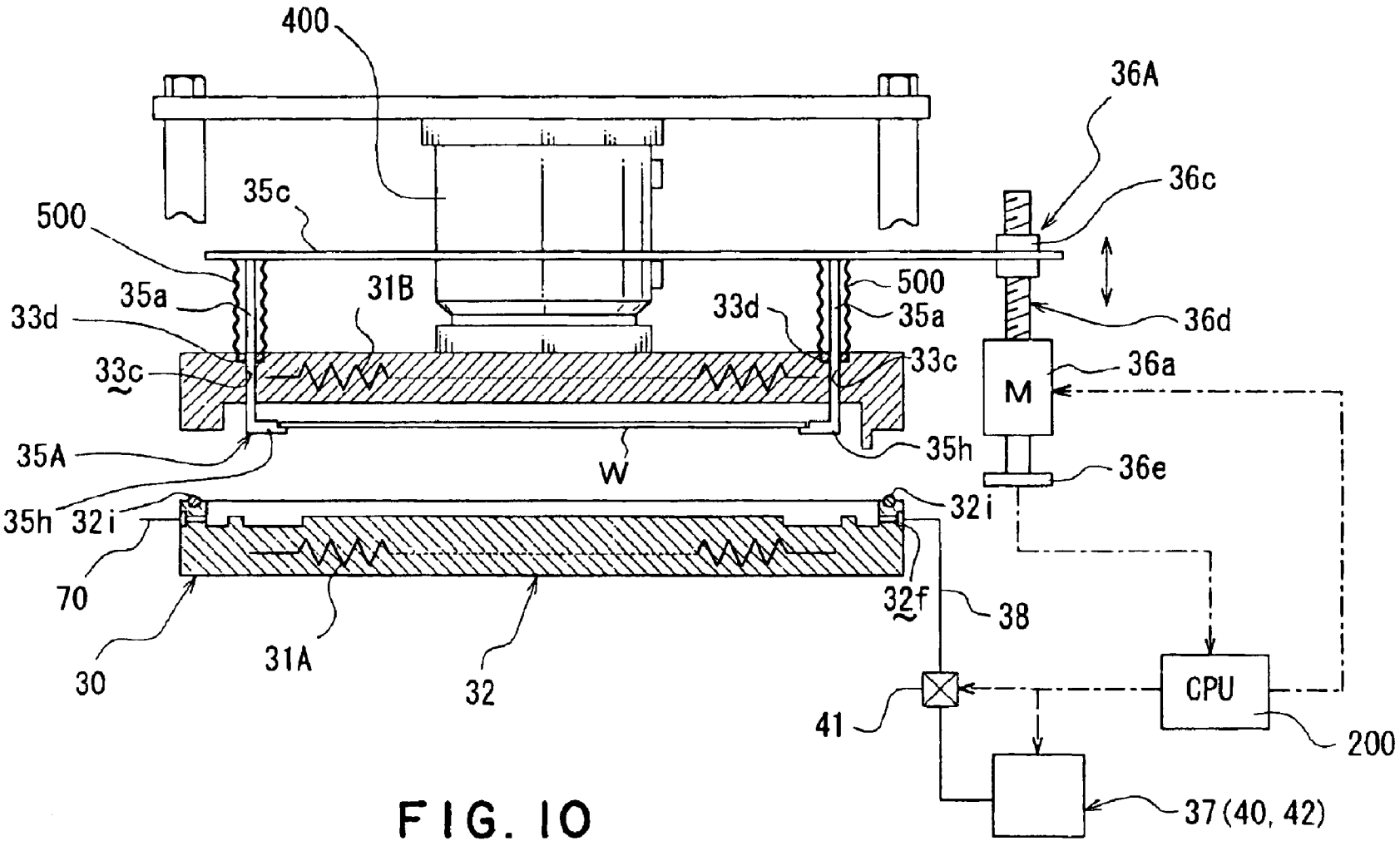
FIG. 10 is an exploded sectional view of the substrate processing apparatus in accordance with the second embodiment of the present invention.
Figure 11A:
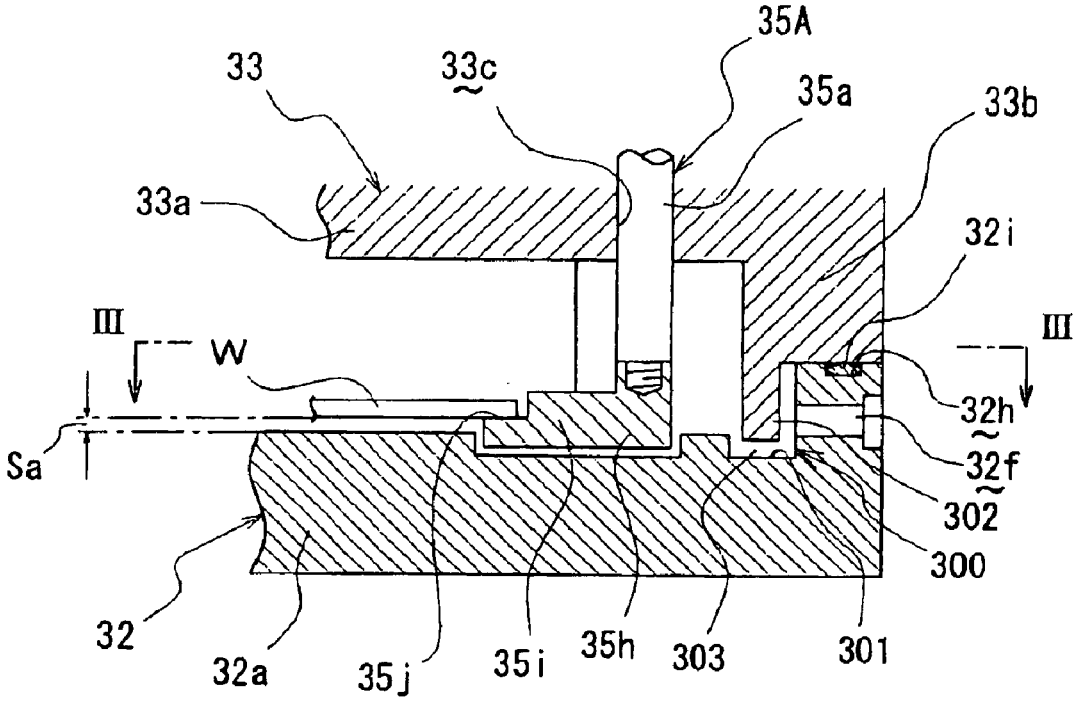
FIG. 11A is a sectional view showing the essential part of the holding unit of the second embodiment and FIG. 11B is a partial sectional view of the substrate processing apparatus taken along a line III—III in FIG. 11A.
Figure 11B:
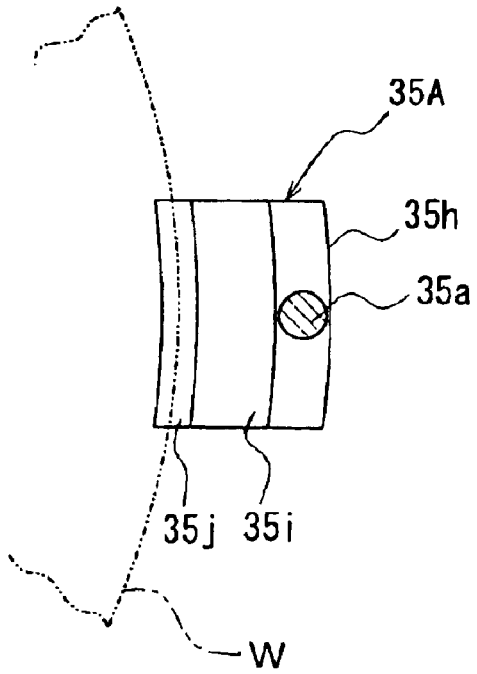

FIG. 10 is an exploded sectional view showing the substrate processing apparatus in accordance with the second embodiment of the invention. FIG. 11A is a sectional view of the holding unit of the second embodiment. FIG. 11B is a sectional view taken along a line III—III of FIG. 11A.

According to the second embodiment, holding unit 35A is arranged so as to penetrate through-holes 33*c* of the rid body 33 forming the processing container 34 in a fluid-tight manner and also adapted so as to be movable close to and apart from the horizontal bottom part 32*a* of the container body 32. That is, the holding unit 35A consists of a plurality of (e.g. four) holding rods 35*a* and the corresponding holding members 35*h*. Each of the holding rods 35*a* is arranged so as to penetrate the through-hole 33*c* formed in the lid body 33 through an O-ring 33*d* as a seal member. The holding rods 35*a* are adapted so as to movably support the wafer W horizontally. While, each of the holding members 35*h* is arranged at the tip of the holding rod 35*a* to support the underside of the periphery of the wafer W. Outside the container body 32, the holding rods 35*a* are connected to the connecting member 35*c*. Through the intermediary of the connecting member 35*c*, the holding unit 35 is associated with close-and-apart moving mechanism (moving unit) 36A.

As shown in FIGS. 11A and 11B, each of the holding members 35*h* is fitted to the leading (lower) end of the holding rod 35*a* in screw engagement. Further, the holding member 35*h* is formed with a substantial L-shaped section. The holding member 35*h* includes a horizontal piece 35*i* and a holding step 35*j* formed at the tip of the horizontal piece 35*i* to support the lower surface of the periphery of the wafer W. When the so-formed holding members 35*h* of the holding unit 35A are moved close to the surface of the horizontal bottom part 32*a* of the container body 32 by the close-and-apart moving mechanism 36A, the members 35*h* are partially accommodated in a recess 32*j* formed on the horizontal bottom part 32*a*, so that the gap Sa from 0.2 to 0.5 mm is produced between the wafer W and the surface of the horizontal bottom part 32*a*.

As similar to the first embodiment, the close-and-apart moving mechanism (moving unit) 36A is formed by a reversal motor 36*a* capable of normal and reverse rotations, such as step motor or servo-motor, and a ball screw mechanism 36*d*. The ball screw mechanism 36*d* has a converting part 36*c* in screw engagement with a screw shaft 36*b* connected to a drive shaft of the motor 36*a* through not-shown balls. Thus, the converting part 36*c* serves to convert the rotational movement of the reversal motor 36*a* to the linear movement. The motor 36*a* is electrically connected to controller, for example, a CPU 200. Thus, by control signals from the CPU 200, the motor 36*a* is rotated in normal and reverse to move the holding rods 35*a* of the holding unit 35A up and down. In other words, with the rotation of the motor 36*a*, the wafer W supported by the holding members 35*h* is moved close to and apart from the heater, in detail, a heating surface of the horizontal bottom part 32*a* of the container body 32. With the control of the CPU 220, the wafer W can stop at the following positions of: adjacent (pre-heating) position Pa (gap Sa: 0.2 to 0.5 mm) to make the wafer W close to the horizontal bottom part 32*a*; processing position Pb (gap Sa: 1 to 2 mm) to make the wafer W apart from the horizontal bottom part 32*a*; and delivery position Ph to elevate the wafer W furthermore. Further, at the processing position Pb, the CPU 200 controls the movement of the wafer W so that it approaches and leaves (oscillate) the horizontal bottom part 32*a* of the container body 32 intermittently or continuously.

Note, the holding rods (parts) 35*a* projecting from the container body 32 downward are enveloped in expandable bellows 500 arranged between the lower surface of the connecting member 35*c* and the upper surface of the lid body 33.

In the second embodiment, the other parts are identical to those of the first embodiment. Therefore, elements identical to those of the first embodiment are indicated with the same reference numerals, respectively and their overlapping descriptions are eliminated.

Figure 12A:
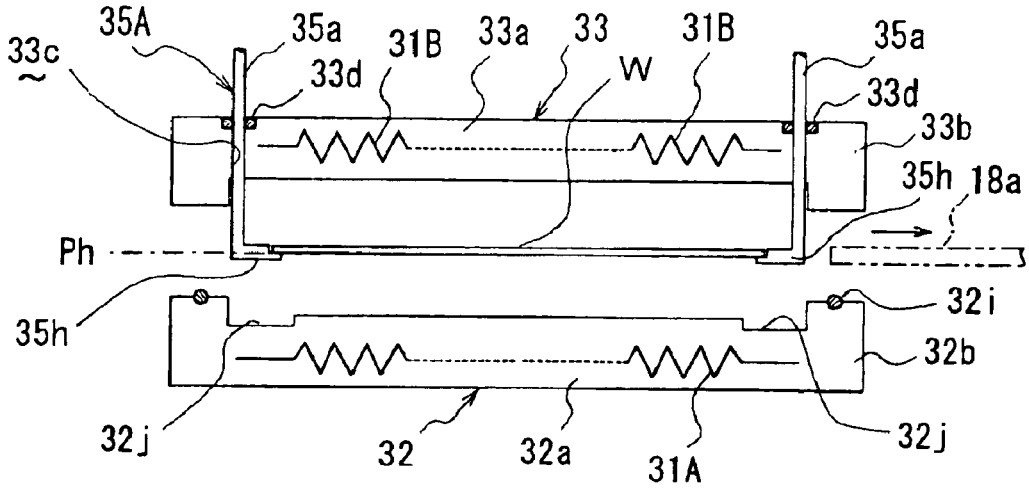
FIGS. 12A, 12B and 12C are explanatory views showing the substrate processing method of the second embodiment in sequence.
Figure 12B:
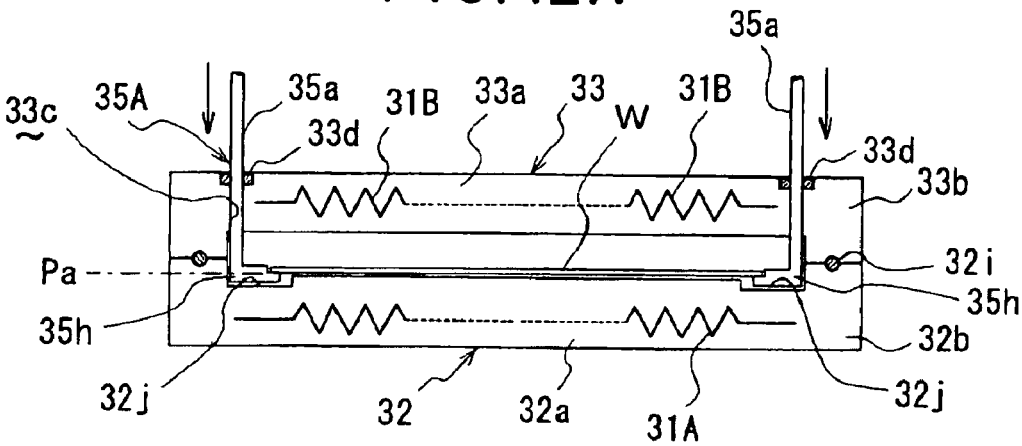
Figure 12C:
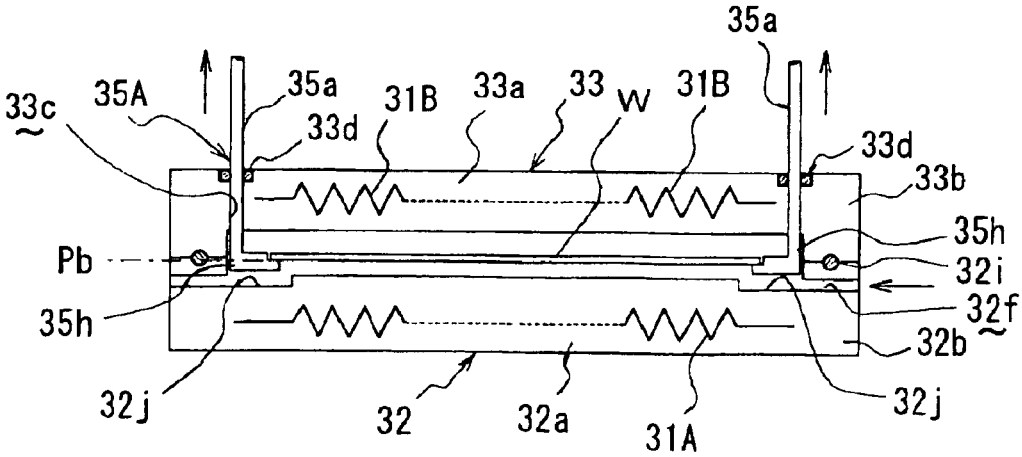

Next, the substrate processing method of the second embodiment will be described with reference to FIGS. 12A, 12B and 12C. First, as similar to the first embodiment, the wafers W are taken out of the carrier C mounted on the mounting table 6, one by one, by the pickup/accommodating arm 11. The wafer W taken out by the arm 11 is transferred to the wafer delivery unit 17. Then, the main wafer transfer unit 18 receives the wafer W and further loads it to each of the ozone treatment units 23*a* to 23*f* in sequence.

In detail, the wafers W are loaded into the processing containers 34 of the ozone treatment units 23*a* to 23*f* while being carried by the transfer arm 18*a* of the main wafer transfer unit 18. At this time, on condition of separating the lid body 33 from the container body 32 defining the processing chamber 34*a*, it is executed to allow the transfer arm 18*a* of the main wafer transfer unit 18 to move to the underside of the lid body 33. Then, the holding members 35*h* of the holding unit 35A are moved upward by the close-and-apart moving mechanism 36A to receive the wafer W from the transfer arm 18*a* (see FIG. 12A). Next, with the driving of the close-and-apart moving mechanism 36A, the holding members 35*h* are lowered to approach the horizontal bottom part 32*a* of the container body 32. Further, the lid body 33 is lowered to make the sagging wall 33*b* in abutment with the top surface of the sidewall 32*b* of the container body 32 while applying a pressure on the O-ring 32*i*. In this way, the container body 32 is sealed up (see FIG. 12B). In this state, a gap Sa (about 0.2 to 0.5 mm) is produced between the lower surface of the wafer W and the surface of the horizontal bottom part of the container body 32. On the establishment of the gap Sa, the heater 31A is turned on electricity for about 30 sec., so that the wafer W is heated up to about a processing temperature (e.g. 100° C.) (preheating process). Consequently, it is possible to promote the resist solubilizing process (ozone processing) of the wafer W.

When the wafer W in the processing chamber 34*a* is heated sufficiently, the information is transmitted to the CPU 200. Then, the CPU 200 transmits a signal for starting the supply of ozone gas to the processing container 34*a*. Additionally, a feedback system having the CPU 200, the ozone gas generator 42 and the ozone-concentration detector 65 allows the ozone concentration to be adjusted at a designated value in feedback control.

By a signal transmitted from the CPU 200 to the flow control valve 52, the ozone gas of a designated concentration is supplied to the processing chamber 34*a* through the main pipeline 38. The processing chamber 34*a* is supplied with the ozone gas having a flow rate corresponding to the flow control value of the flow control valve 52. Note, the flow control value of the flow control valve 52 is previously adjusted in balance with the flow control valve 52. Further, under condition of opening the first exhaust-flow control valve 81 of the exhaust switching part 72, the flow rate of the exhaust gas from the processing chamber 34*a* to the exhaust pipeline 70 is controlled by the first exhaust-flow control valve 81. In this way, by supplying the ozone gas while exhausting the processing chamber 34*a* through the exhaust pipeline 70, the ozone-gas atmosphere is formed in the processing chamber 34*a* while maintaining a constant pressure in the chamber 34*a*. In this case, the pressure in the processing chamber 34*a* is maintained higher than the atmospheric pressure, for example, about 0.2 Mpa in gauge pressure. Further, owing to the provision of the heaters 31A, 31B, the atmosphere in the processing chamber 34*a* and the temperature of the wafer W are maintained as they are. The atmosphere discharged from the processing chamber 34*a* through the exhaust pipeline 70 is introduced into the mist trap 73. In this way, the processing chamber 34*a* is filled up with the ozone gas of a predetermined concentration (ozone-gas charging process).

After charging the ozone gas, the motor 36*a* of the close-and-apart moving mechanism 36A is driven to raise the holding rods 35*a* of the holding unit 35A. As a result, the holding members 35*h* and the wafer W are moved to a processing position Pb (gas Sb=1 to 2 mm) apart from the surface of the horizontal bottom part (see FIG. 12C). At the same time of this operation, the supply chamber 34*a* is supplied with the mixture fluid of ozone gas and vapor, thereby performing the resist solubilizing process (ozone treatment) of the wafer W (ozone treatment process). Then, owing to the provision of the diffusion groove 301 of the communication path 300, the mixture fluid of ozone gas and vapor, which has been supplied into the processing chamber 34*a* through the supply port 32*f*, is diffused horizontally in the chamber 34*a*. Additionally, owing to the formation of the bypass part 303, the mixture fluid flows into the processing chamber 34*a* while making a detour in a direction perpendicular to the horizontal direction of diffusion. Consequently, the mixture fluid is introduced into the processing chamber 34*a* while covering its wide area, so that the wraparound of the mixture fluid against the processed surface of the wafer W can be effected smoothly. Further, by continuously or intermittently driving the motor 36*a* of the close-and-apart moving mechanism 36A in normal and reverse rotations, it may be carried out to allow the wafer W to approach and leave the surface of the horizontal bottom part during the ozone treatment. Then, the wraparound of the mixture fluid against both surfaces of the wafer W can be effected more smoothly to progress the uniformity in processing.

Next, by opening the first exhaust-flow control valve 81 of the exhaust switching part 72 interposed in the exhaust pipeline 70, it is carried out to discharge the mixture fluid (ozone gas, vapor) from the processing chamber 34*a*. In connection, by continuously or intermittently driving the motor 36*a* of the close-and-apart moving mechanism 36A in normal and reverse rotations, it may be carried out to allow the wafer W to approach and leave the surface of the horizontal bottom part. Note, new mixture fluid consisting of ozone gas and vapor may be introduced into the processing chamber 34*a* during the discharging operation of the mixture fluid. In this case as well, the pressure in the processing chamber 34*a* is maintained higher than the atmospheric pressure, for example, the order of 0.2 MPa in gauge pressure. Additionally, the atmosphere in the processing chamber 34*a* and the temperature of the wafer W are together maintained by the heaters 31A, 32B. In this way, the resist coated on the surface of the wafer W is oxidized by the mixture fluid of ozone gas and vapor filled in the processing chamber 34*a* (resist solubilizing process).

On completion of the designated resist solubilizing process (ozone treatment), a large quantity of nitrogen from the nitrogen source 43 is fed to the processing chamber 34*a*. Further, the second exhaust-flow control valve 82 of the exhaust switching part 72 in the exhaust pipeline 70 is opened. As a result, it is possible to purge the main pipeline 38, the processing chamber 34*a* and the exhaust pipeline 70 with nitrogen. The discharged ozone gas is introduced into the mist trap 73 through the exhaust pipeline 70. In this way, the mixture fluid of ozone gas and vapor is discharged from the processing chamber 34*a* (discharging process).

Subsequently, the cylinder mechanism (the elevating means) 400 is operated to move the lid body 33 upward. Next, the motor 36*a* of the close-and-apart moving mechanism 36A is driven to elevate the holding members 35*h* of the holding unit 35A to the delivery position Ph. In this state, it is carried out to move the transfer arm 18*a* of the main wafer transfer unit 18 to the underside of the wafer W. Then, the transfer arm 18*a* receives the wafer W held by the holding members 35*b* and further takes the wafer W out of the processing chamber 34*a* (wafer unloading process).

Note, by the main wafer transfer unit 18, a new wafer W is loaded into the processing chamber 34*a* where the resist solubilizing process (ozone treatment) is performed as well.

[Embodiments]

Figure 13:
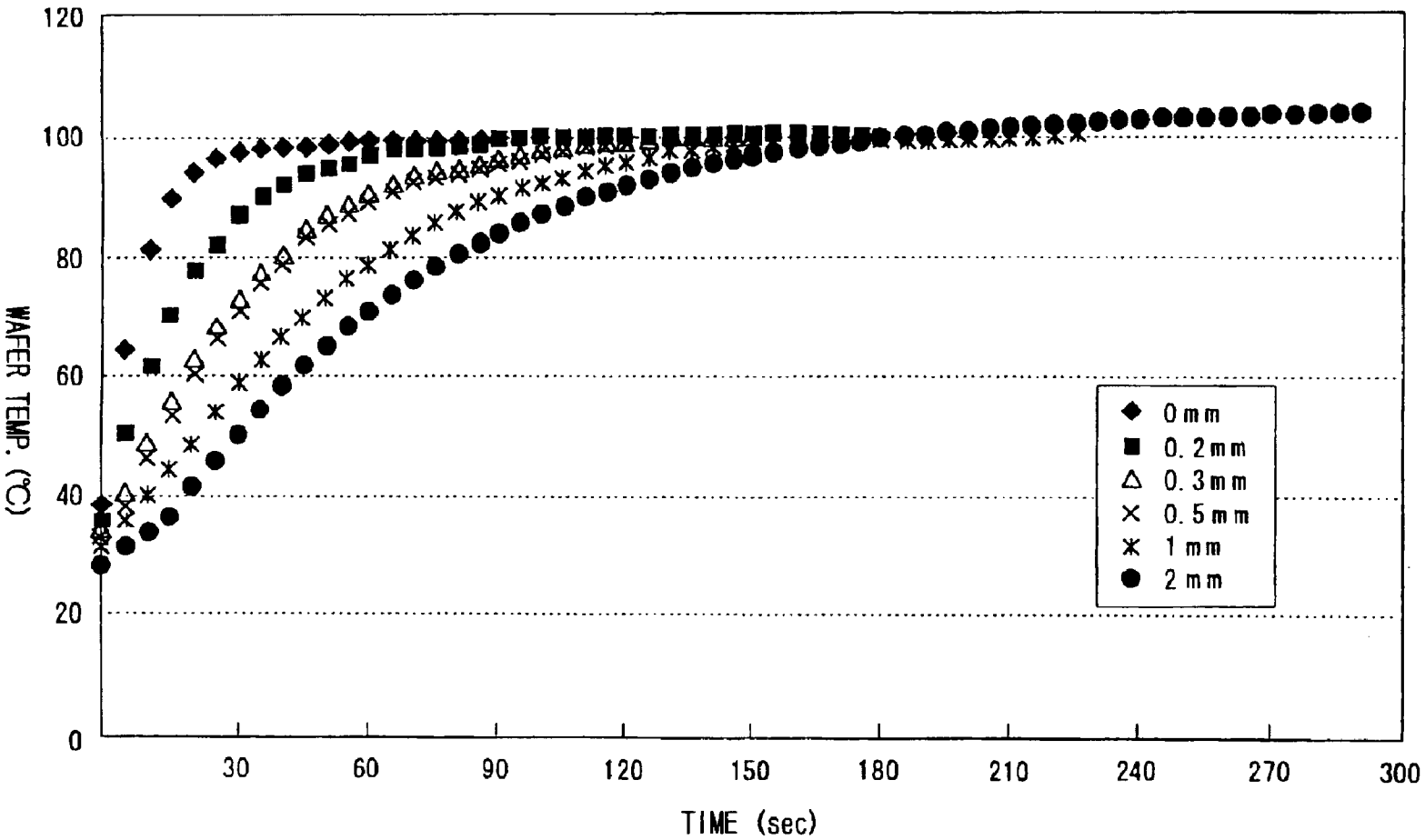
FIG. 13 is a graph showing the warm-up characteristic in case of changing the gap between the substrate (wafer) to be processed and the heater.

We studied rises in temperature of a wafer W in cases that a gap between the wafer W and the heating surface of the heater (i.e. surface of the horizontal bottom part of the container body 32) is 0 mm, 0.2 mm, 0.3 mm, 0.5 mm, 1 mm, 2 mm or 4 mm. The result of test is shown in FIG. 13. Consequently, in case of the gap of 0.2 mm, we confirmed that the wafer W was heated up to 90° C. (near the processing temperature) for 30 sec. and 100° C. for 60 sec. Further, in both cases of 0.3 mm and 0.5 mm, the wafers W were heated up to 90° C. (near the processing temperature) for 55~60 sec. and about 100° C. for 90 sec. commonly. While, in case of the gap of 1 mm, we confirmed that the wafer W was heated up to 90° C. (near the processing temperature) for 90 sec. and 100° C. for 150 sec. Further, in case of 2 mm, the wafer W was heated up to 90° C. (near the processing temperature) for 100 sec. and 100° C. for 180 sec. In case of the gap of 4 mm, we confirmed the similar temperature characteristics to that of the gap of 2 mm.

As the result of the above test, it is found that the establishment of 0.2~0.5 mm in the gap between a wafer W and the heating surface of the heater (i.e. surface of the horizontal bottom part of the container body 32), which is smaller than a gap at the processing position (gap: 1~2 mm), allows the wafer W to be heated up to 90° C. near the processing temperature). Considering that the rise in temperature could be maintained by the heater even if the wafer W is moved to the processing position after it has been heated up to 90° C. it is also found that even if the gap is changed to that at the processing position (gap: 1~2 mm) after the wafer W has been heated for 30 sec. on the establishment of 0.2~0.5 mm in the gap, the processing temperature would not make any hindrance on the wafer W. To the contrary, it is further found that when the gap is from 1 to 2 mm at the processing position, it takes a period from 60 to 120 sec. to maintain the processing temperature in spite of continuing the heating operation. Accordingly, by heating the wafer W in a period of about 30 sec. on the establishment of 0.2~0.5 mm in the gap between the wafer W and the heating surface of the heater (i.e. surface of the horizontal bottom part of the container body 32) and sequentially performing the ozone treatment on the establishment of the gap at the processing position (gap: 1~2 mm), it is possible to shorten the process time by half to quarter (½~¼) of the process time in case of heating the wafer W on the establishment of the gap at the processing position (gap: 1~2 mm) from the beginning and sequentially performing the ozone treatment.

[Other Embodiments]

(1) In the above-mentioned embodiments, the number of holding rods 35*a* of the holding unit 35, 35A are four. However, not always four rods, the holding unit 35, 35A may be formed by three holding rods 35*a*.

(2) In the above-mentioned embodiments, with the movements of the holding unit 35, 35A close to and apart from the heating surface of the heater (i.e. the surface of the horizontal bottom part 32*a* of the container body 32) due to the close-and-apart moving mechanism 36, 36A, there are established the adjacent (preheating) position Pa, the processing position Pb and the delivery position Ph, with respect to a gap between the wafer W and the heating surface of the heater. Further, at the processing position Pb, the holding unit 35, 35A and the heating surface of the heater are relatively moved close to and apart from each other (oscillated) intermittently or continuously. However, the invention is not limited in its application to the above-mentioned structure. For example, it may be carried out to move the heater (e.g. the heaters 31*a*, 31A) close to and apart from the holding unit 35, 35A, namely, the wafer W. Alternatively, both of the holding unit 35, 35A and the heater may be moved close to and apart from each other relatively.

(3) In the above-mentioned embodiments, the substrate processing method of the invention is applied to an apparatus employing the mixture fluid of ozone gas and vapor. However, if only supplying a processing fluid, such as gas or liquid, the present invention is applicable to substrate processing method and apparatus using any processing fluid besides the mixture fluid of ozone gas and vapor.

(4) In the above-mentioned embodiments, a semiconductor wafer is representative of the substrate to be processed in the invention. However, needless to say, the present invention is applicable to other substrates, for example, LCD substrate, reticle substrate for photo mask, etc.

What is claimed is:

1. A substrate processing method for heating a substrate to be processed to a predetermined temperature, the substrate being held by a holder and also accommodated in a processing container equipped with a heater, and further processing the substrate to be processed while supplying a processing fluid into the processing container, the method comprising the steps of:

moving the substrate to be processed close to a heating surface of the heater relatively thereby to heat the substrate to be processed to a processing temperature;

moving the substrate to be processed apart from the heating surface of the heater to a processing position after heating the substrate to the processing temperature; and supplying the processing fluid into the processing container, wherein the holder and the heating surface of the heater are relatively moved close to and apart from each other intermittently or continuously.

2. A substrate processing method for heating a substrate to be processed to a predetermined temperature, the substrate being held by a holder and also accommodated in a processing container equipped with a heater, and further processing the substrate to be processed while supplying a processing fluid into the processing container, the method comprising the steps of:

moving the substrate to be processed close to a heating surface of the heater relatively thereby to heat the substrate to be processed to a processing temperature;

moving the substrate to be processed apart from the heating surface of the heater to a processing position after heating the substrate to the processing temperature; and supplying the processing fluid into the processing container, wherein the holder is capable of moving in and out of a processing chamber thereby plunging into the processing chamber through the processing chamber, the substrate to be processed being supported by the holder horizontally, and the holder being moved vertically to make the holder and the heating surface of the heater close to and apart from each other relatively.

3. A substrate processing method for heating a substrate to be processed to a predetermined temperature, the substrate being held by a holder and also accommodated in a processing container equipped with a heater, and further processing the substrate to be processed while supplying a processing fluid into the processing container, the processing container having a container body and a lid body, the method comprising the steps of:

opening the lid body;

making the holder receive the substrate transferred from the exterior of the processing container at a delivery position;

moving the substrate to be processed close to a heating surface of the heater relatively;

closing the lid body;

heating the substrate to be processed to a processing temperature;

moving the substrate to be processed apart from the heating surface of the heater to a processing position after heating the substrate to the processing temperature; and supplying the processing fluid into the processing container;

discharging the processing fluid for processing from the interior of the processing container; and again opening the lid body, transferring the substrate from the processing position to the delivery position and unloading the substrate out of the processing container, wherein the lid body and the container body are separated by a plane along the substrate, and wherein a moving direction when the lid body relatively comes into contact with and relatively moves apart from the container body is substantially perpendicular to the substrate.

4. A substrate processing apparatus comprising:

a processing container for accommodating a substrate to be processed, the processing container having a supply port for supplying a processing fluid into the processing container;

a holder for holding the substrate in the processing container;

a heater provided to the processing container for heating the substrate to a predetermined temperature;

a supply pipeline connected to the supply port;

a valve interposed in the supply pipeline;

a processing fluid source for supplying the processing fluid into the processing container through the supply pipeline;

a close-and-apart moving mechanism for moving the substrate held by the holder close to or apart from a heating surface of the heater relatively;

a connecting member arranged outside the processing container, for connecting the close-and-apart moving mechanism with the holder; and a controller for controlling the close-and-apart motion of the close-and-apart moving mechanism and the open-and-close operation of the valve, wherein the holder includes a plurality of holding rods arranged so as to penetrate the processing container movably in a fluid-tight manner through a through-hole formed in the processing container and to project into the processing container, the holding rods being connected, at their parts outside the processing container, with the close-and-apart moving mechanism through the connecting member; and holding members arranged at respective tips of the holding rods to support the underside of the periphery of the substrate thereby holding the substrate horizontally, each of the holding members having a holding part for supporting the lower surface of the periphery of the substrate and a standing part formed to stand upwardly from the outer portion of the holding part over the upper surface of the substrate, the standing part having an inside surface inclined to the holding part so as to gradually reduce a thickness between the inside surface of the standing part and the outer circumference of the standing part as directed upward.

5. A substrate processing apparatus comprising:

a processing container for accommodating a substrate to be processed, the processing container having a supply port for supplying a processing fluid into the processing container;

a holder for holding the substrate in the processing container;

a heater provided to the processing container for heating the substrate to a predetermined temperature;

a supply pipeline connected to the supply port;

a valve interposed in the supply pipeline;

a processing fluid source for supplying the processing fluid into the processing container through the supply pipeline;

a close-and-apart moving mechanism for moving the substrate held by the holder close to or apart from a heating surface of the heater relatively, the close-and-apart moving mechanism including a motor rotatable in both directions and a ball screw mechanism having a converting part to convert the rotational movement of the motor to a linear movement; and a controller for controlling the close-and-apart motion of the close-and-apart moving mechanism and the open-and-close operation of the valve.

6. A substrate processing apparatus comprising:

a processing container for accommodating a substrate to be processed, the processing container having a supply port for supplying a processing fluid into the processing container;

a holder for holding the substrate in the processing container;

a heater provided to the processing container for heating the substrate to a predetermined temperature;

a supply pipeline connected to the supply port;

a valve interposed in the supply pipeline;

a processing fluid source for supplying the processing fluid into the processing container through the supply pipeline;

a close-and-apart moving mechanism for moving the substrate held by the holder close to or apart from a heating surface of the heater relatively; and a controller for controlling the close-and-apart motion of the close-and-apart moving mechanism and the open-and-close operation of the valve, wherein the controller controls the close-and-apart moving mechanism in a manner that the substrate to be processed moves to a delivery position where the substrate is delivered into the processing container, an adjacent position where the substrate is opposed to the heating surface of the heater and a processing position where the substrate is apart from the heating surface of the heater over the adjacent position, and in a manner that the substrate at the processing position moves close to and apart from the heating surface of the heater intermittently or continuously, and further controls the opening-and-closing operation of the valve in the supply pipeline in order to supply the substrate at the processing position with the processing fluid.

7. A substrate processing apparatus comprising:

a processing container for accommodating a substrate to be processed, the processing container having a supply port for supplying a processing fluid into the processing container;

a holder for holding the substrate in the processing container;

a heater provided to the processing container for heating the substrate to a predetermined temperature;

a supply pipeline connected to the supply port;

a valve interposed in the supply pipeline;

a processing fluid source for supplying the processing fluid into the processing container through the supply pipeline;

a close-and-apart moving mechanism for moving the substrate held by the holder close to or apart from a heating surface of the heater relatively; and a controller for controlling the close-and-apart motion of the close-and-apart moving mechanism in a manner that the substrate to be processed moves to a delivery position where the substrate is delivered into the processing container, an adjacent position where the substrate is opposed to the heating surface of the heater and a processing position where the substrate is apart from the heating surface of the heater over the adjacent position, the controller controlling the open-and-close operation of the valve in the supply pipeline in order to supply the substrate at the processing position with the processing fluid, wherein the processing container includes a container body having its horizontal bottom part provided with the heater to form the heating surface, the container body having a fluid supply port and a drain port for the processing fluid, and a lid body being movable up and down and having another heater, the lid body being adapted so as to close an opening of the container body through a seal member, the moving of the substrate between the adjacent position and the processing position being carried out under the condition that the container body is closed by the lid body.

8. A substrate processing apparatus comprising:

a processing container for accommodating a substrate to be processed, the processing container having a supply port for supplying a processing fluid into the processing container;

a holder for holding the substrate in the processing container;

a heater provided to the processing container for heating the substrate to a predetermined temperature;

a supply pipeline connected to the supply port;

a valve interposed in the supply pipeline;

a processing fluid source for supplying the processing fluid into the processing container through the supply pipeline;

a close-and-apart moving mechanism for moving the substrate held by the holder close to or apart from a heating surface of the heater relatively; and a controller for controlling the close-and-apart motion of the close-and-apart moving mechanism and the open-and-close operation of the valve, wherein the processing container includes a container body and a lid body, the lid body and the container body being separated by a plane along the substrate, a moving direction when the lid body relatively comes into contact with and relatively moves apart from the container body being substantially perpendicular to the substrate.

9. A substrate processing apparatus as claimed in claim 8 wherein the container body has it horizontal bottom part provided with the heater to form the heating surface and has a fluid supply port and a drain port for the processing fluid, wherein the lid body that is movable up and down and is adapted so as to close an opening of the container body through a seal member, and wherein a moving of the substrate between an adjacent position where the substrate is opposed to the heating surface of the heater and a processing position where the substrate is apart from the heating surface of the heater over the adjacent position is carried out under condition that the container body is close by the lid body.

10. A substrate processing apparatus as claimed in claim 8, wherein the holder includes a plurality of holding rods arranged so as to penetrate the lid body movably in a fluid-tight manner through a through-hole formed in the lid body and projected into the processing container, the holding rods being connected with the close-and-apart moving mechanism; and a holding member arranged at respective tips of the holding rods to support the underside of the periphery of the substrate thereby holding it horizontally.

11. A substrate processing apparatus comprising:

a processing container for accommodating a substrate to be processed, the processing container having a fluid supply port for supplying a processing fluid into the processing container and a drain port formed at opposing parts of a sidewall standing from the periphery of the horizontal bottom part, the processing container having a container body and a lid body being movable up and down in the vertical direction and also being adapted so as to close an opening of the container body through a seal member;

a holder for holding the substrate in the processing container;

a heater arranged in a horizontal bottom part of the container body forming the heating surface for heating the substrate to a predetermined temperature;

a supply pipeline connected to the supply port;

a valve interposed in the supply pipeline;

a processing fluid source for supplying the processing fluid into the processing container through the supply pipeline;

a close-and-apart moving mechanism for moving the substrate held by the holder close to or apart from a heating surface of the heater relatively; and a controller for controlling the close-and-apart motion of the close-and-apart moving mechanism and the open-and-close operation of the valve, wherein the processing container has a communication path to communicate the fluid supply port with the interior of the processing container, the communication path having a bypass part having a diffusion groove extending from the fluid supply port to both sides thereof and a sagging piece plunging into the diffusion groove.

* * * * *